US010470513B2

(12) United States Patent
Grinneback et al.

(10) Patent No.: US 10,470,513 B2
(45) Date of Patent: Nov. 12, 2019

(54) HELMET

(71) Applicant: MIPS AB, Täby (SE)

(72) Inventors: Kay Grinneback, Täby (SE); Daniel Lanner, Täby (SE); Marcus Seyffarth, Täby (SE)

(73) Assignee: MIPS AB, Täby (SE)

( * ) Notice: Subject to any disclaimer, the term of this patent is extended or adjusted under 35 U.S.C. 154(b) by 0 days.

(21) Appl. No.: 15/833,032

(22) Filed: Dec. 6, 2017

(65) Prior Publication Data

US 2018/0092423 A1 Apr. 5, 2018

Related U.S. Application Data

(63) Continuation of application No. 15/579,710, filed as application No. PCT/EP2017/054663 on Feb. 28, 2017.

(30) Foreign Application Priority Data

Mar. 1, 2016 (GB) ..... 1603566.9

(51) Int. Cl.
*A42B 3/00* (2006.01)
*A42B 3/06* (2006.01)

(52) U.S. Cl.
CPC ..... *A42B 3/064* (2013.01)

(58) Field of Classification Search
CPC ..... A42B 3/064; A42B 3/06; A42B 3/063; A42B 3/125; A42B 3/121
USPC ..... 2/411, 412
See application file for complete search history.

(56) References Cited

U.S. PATENT DOCUMENTS

| | | | |
|---|---|---|---|
| 3,723,566 A | 3/1973 | Thompson et al. | |
| 4,565,725 A | 1/1986 | Spamer et al. | |
| 4,673,718 A | 6/1987 | Ryntz et al. | |
| 5,794,270 A | 8/1998 | Howat | |
| 5,925,418 A | 7/1999 | Theders | |
| 2003/0199398 A1 | 10/2003 | Dorrbecker et al. | |
| 2009/0265839 A1 | 10/2009 | Young et al. | |
| 2010/0221521 A1* | 9/2010 | Wagner | B01F 17/0028 428/315.5 |

(Continued)

FOREIGN PATENT DOCUMENTS

| | | |
|---|---|---|
| CN | 102015897 A | 4/2011 |
| CN | 102585679 | 7/2012 |

(Continued)

OTHER PUBLICATIONS

English machine translation of EP 0759275 A1. via www.espacenet.com.*

(Continued)

*Primary Examiner* — Jameson D Collier
(74) *Attorney, Agent, or Firm* — Perkins Coie LLP

(57) ABSTRACT

A helmet having two layers that slide with respect to each other is provided. The surface of one or both layers includes a sliding facilitator to improve slidability between the two layers. The sliding facilitator includes at least one of (i) an organic polymer, a polysiloxane and surfactant; (ii) an organic polymer and a copolymer based on a polysiloxane and an organic polymer; or (iii) a non-elastomeric cross-linked polymer obtained or obtainable by subjecting a polysiloxane and an organic polymer to a cross-linking reaction.

22 Claims, 3 Drawing Sheets

(56) References Cited

U.S. PATENT DOCUMENTS

| | | | | |
|---|---|---|---|---|
| 2011/0045630 | A1 | 2/2011 | Serhatkulu | |
| 2011/0046306 | A1 | 2/2011 | Serhatkulu | |
| 2012/0047640 | A1 | 3/2012 | Warkotsch et al. | |
| 2012/0060251 | A1* | 3/2012 | Schimpf | A42B 3/064 2/5 |
| 2012/0186003 | A1 | 7/2012 | Heger et al. | |
| 2012/3004239 | | 2/2013 | Halldin | |
| 2014/0109299 | A1* | 4/2014 | Kwan | A41D 13/015 2/413 |
| 2014/0161758 | A1 | 6/2014 | Tamura et al. | |
| 2014/0189945 | A1* | 7/2014 | Golnaraghi | A42B 3/064 2/455 |
| 2014/0205804 | A1 | 7/2014 | Jones et al. | |
| 2015/0126631 | A1* | 5/2015 | Bruno | A42B 3/125 521/54 |
| 2016/0194574 | A1 | 7/2016 | Gross et al. | |
| 2016/0201005 | A1 | 7/2016 | Nowak et al. | |
| 2018/0027913 | A1* | 2/2018 | Thiel | A42B 1/08 |

FOREIGN PATENT DOCUMENTS

| | | | | |
|---|---|---|---|---|
| CN | 102585679 | A | 7/2012 | |
| CN | 102811639 | A | 12/2012 | |
| EP | 0759275 | | 2/1997 | |
| EP | 0759275 | A1 * | 2/1997 | A42B 3/061 |
| EP | 2192144 | | 6/2010 | |
| EP | 2192144 | A1 | 6/2010 | |
| JP | 2001-316626 | A | 11/2001 | |
| JP | 2001316626 | | 11/2001 | |
| JP | 2003518203 | A | 6/2003 | |
| JP | 2011518905 | A | 6/2011 | |
| JP | 2014234513 | A | 12/2014 | |
| JP | 2015178629 | A | 10/2015 | |
| WO | 01/45526 | A1 | 6/2001 | |
| WO | WO 01/45526 | | 6/2001 | |
| WO | WO 2004032659 | | 4/2004 | |
| WO | 2009132947 | A1 | 11/2009 | |
| WO | 2011/087435 | A1 | 7/2011 | |
| WO | WO 2011087435 | | 7/2011 | |
| WO | 2011/139224 | A1 | 11/2011 | |
| WO | WO 2011139224 | | 11/2011 | |
| WO | 2012165235 | A1 | 6/2012 | |
| WO | 2014/171889 | A1 | 10/2014 | |
| WO | WO 2014171889 | | 10/2014 | |
| WO | 2015/035068 | A1 | 3/2015 | |
| WO | WO 2015035068 | | 3/2015 | |
| WO | 2015/103634 | A2 | 7/2015 | |
| WO | WO 2015103634 | | 7/2015 | |

OTHER PUBLICATIONS

ShenZhen Meilihua Ink & Coationg Co., Ltd. Material Safety Data Sheet, 1 page.

Kleiven, "Finite Element Modeling of the Human Head", (2002), Doctoral Thesis, Technical Report 2002-2009, Department of Aeronautics, Royal Institute of Technology, Stockholm, Sweden, Apr. 2002, 63 pp.

Combined Search and Examination Report regarding application No. GB1603566.9 issued by the UK Intellectual Property Office, dated Sep. 2, 2016, 9 pages.

International Search Report regarding PCT/EP2017/054663 issued by the European Patent Office, dated May 8, 2017, 6 pages.

Search Report regarding application No. GB1603566.9 issued by the UK Intellectual Property Office, dated Mar. 30, 2017, 3 pages.

Search Report regarding application No. GB1603566.9 issued by the UK Intellectual Property Office, dated Mar. 30, 2017, 5 pages.

Written Opinion of the International Searching Authority regarding PCT/EP2017/054663 issued by the European Patent Office, dated May 8, 2017, 5 pages.

Colas, "Silicones: Preparation, Properties and Performance", Dow Corning, Life Sciences, Form 01-3077-01, retrieved online, Feb. 2016, 14 pages.

Colas, et al., "Silicones in Pharmaceutical Applications. Part 5: Siliconization of Parenteral Packaging Components", Dow Corning Corporation, Form No. 52-1094-01, retrieved online, Feb. 2016, 5 pages.

Dow Corning Paints & Inks Solutions—Coatings & Inks Additive Selection Guide, Form No. 24-391EE-01, retrieved online, Feb. 2016, 16 pages.

Gross, "Analysis of Silicones Released from Household Items and Baby Articles by Direct Analysis in Real Time-Mass Spectrometry", J. Am. Soc. Mass Spectrom (2015) 26:511-521.

James, "Silicone polyethers enhance coatings", Dow Corning, PPCJ, Dec. 2011, 2 pages.

Kleiven, "Evaluation of head injury criteria using a finite element model validated against experiments on localized brain motion, intracerebral acceleration, and intracranial pressure", (2006), International Journal of Crashworthiness, vol. 11, No. 1, pp. 65-79.

Kleiven, "Finite Element Modeling of the Human Head", (2002), Doctoral Thesis, Technical Report 2002-9, Department of Aeronautics, Royal Institute of Technology, Stockholm, Sweden, Apr. 2002, 63 pp.

Kleiven, "Predictors for Traumatic Brain Injuries Evaluated through Accident Reconstructions", Oct. 2007, Stapp Car Crash Journal, vol. 51,35 pages.

Kuo, "Poly(dimethylsiloxane)", Polymer Data Handbook, Oxford University Press, 1999, pp. 411-435.

Perry, "Silicone Surface-Active Agents", Dow Corning Corporation, Form No. 26-1365-01, retrieved online, Feb. 2016, 12 pages.

Product Information, Paints, Inks & Coatings—Dow Corning 52 Additive, Form No. 26-1099B-01, Mar. 15, 2013, 5 pages.

Product Information, Paints, Inks & Coatings—Dow Corning 57 Additive, Form No. 25-301G-01, Oct. 16, 2013, 2 pages.

Product Information Sheet for Advalon FF 230 VP, Jan. 14, 2009, 1 page.

Product Information Sheet for BYK-Silclean 3700, Jul. 2015, 2 pages.

Product Information Sheet for Elastosil 47007, Nov. 6, 2014, 2 pages.

"Reactive & Non-Reactive Modified Silicone Fluid", Shin-Etsu Silicone Catalog, retrieved online, Feb. 2016, 10 pages.

"Reactive Silicones: Forging New Polymer Links", Gelest, Inc., retrieved online, Feb. 2016, 64 pages.

Ryan, et al., "Ultra High Molecular Weight Functional Siloxane Additives in Polymers: Effects on Processing and Properties", Dow Corning Corporation, Form No. 26-036A-901, retrieved online, Feb. 2016, 16 pages.

Safety Data Sheet for BYK-Silclean 3700, Apr. 1, 2011, 6 pages.

Safety Data Sheet for Dow Corning 205SL Additive, Oct. 13, 2015, 10 pages.

Safety Data Sheet for Dow Corning 57 Additive, Sep. 24, 2015, 8 pages.

ShenZhen Meilihua Ink & Coating Co., Ltd. Material Safety Data Sheet, 1 page.

Shenzen Meilihua Ink & Coating Co,, Ltd, "Safety Data Sheet for ShenZhen Screen Printing Ink (S-23 Cyclohexanone)," 5 pages.

Shenzen Meilihua Ink & Coating Co,, Ltd, "Safety Data Sheet for ShenZhen Screen Printing Ink (S-3 Slow dry water)", 5 pages.

Shenzen Meilihua Ink & Coating Co,, Ltd, "Safety Data Sheet for ShenZhen Screen Printing Ink (S-3D Open the Oil-Water)," 6 pages.

Shenzen Meilihua Ink & Coating Co,, Ltd, "Safety Data Sheet for ShenZhen Screen Printing Ink (S-3DK Open the Oil-Water)," 6 pages.

Shenzen Meilihua Ink & Coating Co,, Ltd, "Safety Data Sheet for ShenZhen SSB/QSSB Screen Printing Ink," 6 pages.

Shenzen Meilihua Ink & Coating Co,, Ltd, "Safety Data Sheet for ShenZhen SSK-110 Screen Printing Ink," 5 pages.

Shenzen Meilihua Ink & Coating Co,, Ltd, "Safety Data Sheet for ShenZhen SSY/QSSY Screen Printing Ink," 6 pages.

* cited by examiner

HELMET

RELATED APPLICATIONS

This application is a continuation of U.S. application Ser. No. 15/579,710, entitled "HELMET," filed on Dec. 5, 2017, which is a 35 USC § 371 National Stage application of International Application No. PCT/EP2017/054663, entitled "HELMET," filed on Feb. 28, 2017, which claims priority to Great Britain Application No. 1603566.9, filed Mar. 1, 2016, the contents of which are incorporated by reference herein in their entireties.

The present invention relates to helmets. In particular, the invention relates to facilitating sliding of layers in a helmet, to improve protecting against oblique impacts.

Helmets are known for use in various activities. These activities include combat and industrial purposes, such as protective helmets for soldiers and hard-hats or helmets used by builders, mine-workers, or operators of industrial machinery for example. Helmets are also common in sporting activities. For example, protective helmets may be used in ice hockey, cycling, motorcycling, motor-car racing, skiing, snow-boarding, skating, skateboarding, equestrian activities, American football, baseball, rugby, cricket, lacrosse, climbing, golf, airsoft and paintballing.

Helmets can be of fixed size or adjustable, to fit different sizes and shapes of head. In some types of helmet, e.g. commonly in ice-hockey helmets, the adjustability can be provided by moving parts of the helmet to change the outer and inner dimensions of the helmet. This can be achieved by having a helmet with two or more parts which can move with respect to each other. In other cases, e.g. commonly in cycling helmets, the helmet is provided with an attachment device for fixing the helmet to the user's head, and it is the attachment device that can vary in dimension to fit the user's head whilst the main body or shell of the helmet remains the same size. Such attachment devices for seating the helmet on a user's head may be used together with additional strapping (such as a chin strap) to further secure the helmet in place. Combinations of these adjustment mechanisms are also possible.

Helmets are often made of an outer shell, that is usually hard and made of a plastic or a composite material, and an energy absorbing layer called, a liner. Nowadays, a protective helmet has to be designed so as to satisfy certain legal requirements which relate to inter alia the maximum acceleration that may occur in the centre of gravity of the brain at a specified load. Typically, tests are performed, in which what is known as a dummy skull equipped with a helmet is subjected to a radial blow towards the head. This has resulted in modern helmets having good energy-absorption capacity in the case of blows radially against the skull. Progress has also been made (e.g. WO 2001/045526 and WO 2011/139224, which are both incorporated herein by reference, in their entireties) in developing helmets to lessen the energy transmitted from oblique blows (i.e. which combine both tangential and radial components), by absorbing or dissipating rotation energy and/or redirecting it into translational energy rather than rotational energy.

Such oblique impacts (in the absence of protection) result in both translational acceleration and angular acceleration of the brain. Angular acceleration causes the brain to rotate within the skull creating injuries on bodily elements connecting the brain to the skull and also to the brain itself.

Examples of rotational injuries include concussion, subdural haematomas (SDH), bleeding as a consequence of blood vessels rapturing, and diffuse axonal injuries (DAI), which can be summarized as nerve fibres being over stretched as a consequence of high shear deformations in the brain tissue.

Depending on the characteristics of the rotational force, such as the duration, amplitude and rate of increase, either SDH, DAI or a combination of these injuries can be suffered. Generally speaking, SDH occur in the case of accelerations of short duration and great amplitude, while DAI occur in the case of longer and more widespread acceleration loads.

However, the field of helmets for protecting against oblique impacts is still developing. The present invention aims to provide improved oblique impact protection.

The present invention provides a helmet comprising:

two layers configured to slide with respect to each other; and wherein the surface of one or both layers comprises a sliding facilitator to improve slidability between the two layers, wherein the sliding facilitator comprises (i) an organic polymer, a polysiloxane and a surfactant;

(ii) an organic polymer and a copolymer based on a polysiloxane and an organic polymer; or (iii) a non-elastomeric cross-linked polymer obtained or obtainable by subjecting a polysiloxane and an organic polymer to a cross-linking reaction.

The present invention also provides a method of manufacturing a helmet, the method comprising:

applying or forming a sliding facilitator on a surface of a first lay helmet;

and arranging the layer with respect to another layer of the helmet such that the two layers are configured to slide with respect to each other, with the sliding positioned between the two layers;

wherein the sliding facilitator comprises (i) an organic polymer, a polysiloxane and a surfactant;

(ii) an organic polymer and a copolymer based on a polysiloxane and an organic polymer; or (iii) a non-elastomeric cross-linked polymer obtained or obtainable by subjecting a polysiloxane and an organic polymer to a cross-linking reaction.

The invention is described below by way of non-limiting examples, with reference to the accompanying drawings, in which.

Figure 1:
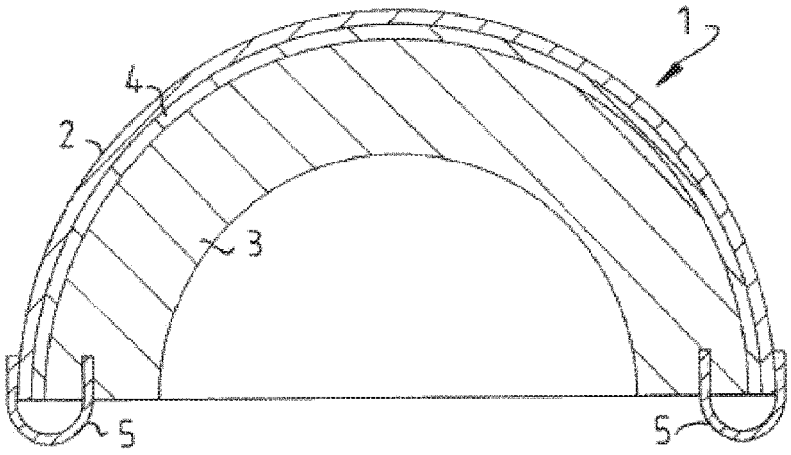
FIG. 1 depicts a cross section through a helmet r providing protection against oblique impacts.

The proportions of the thicknesses of the various layers in the helmets depicted in the figures have been exaggerated in the drawings for the sake of clarity and can of course be adapted according to need and requirements.

FIG. 1 depicts a first helmet 1 of the sort discussed in WO 01/45526, intended for providing protection against oblique impacts. This type of helmet could be any of the types of helmet discussed above.

Protective helmet 1 is constructed with an outer shell 2 and, arranged inside the outer shell 2, an inner shell 3 that is intended for contact with the head of the wearer.

Arranged between the outer shell 2 and the inner shell 3 is a sliding layer 4 or a sliding facilitator, and thus makes possible displacement between the outer shell 2 and the inner shell 3. In particular, as discussed below, a sliding layer 4 or sliding facilitator may be configured such that sliding may occur between two parts during an impact. For example, it may be configured to enable sliding under forces associated with an impact on the helmet 1 that is expected to be survivable for the wearer of the helmet 1. In some arrangements, it may be desirable to configure the sliding layer or sliding facilitator such that the coefficient of friction is from 0.001 to 0.3, preferably from 0.01 to 03, more preferably from 0.05 to 0.3.

Arranged in the edge portion of the helmet 1, in the FIG. 1 depiction, may be one or more connecting members 5 which interconnect the outer shell 2 and the inner shell 3. In some arrangements, the connectors may counteract mutual displacement between the outer shell 2 and the inner shell 3 by absorbing energy. However, this is not essential. Further, even where this feature is present, the amount of energy absorbed is usually minimal in comparison to the energy absorbed by the inner shell 3 during an impact. In other arrangements, connecting members 5 may not be present at all.

Further, the location of these connecting members 5 can be varied (for example, being positioned away from the edge portion, and connecting the outer shell 2 and the inner shell 3 through the sliding layer 4).

The outer shell 2 is preferably relatively thin and strong so as to withstand impact of various types. The outer shell 2 could be made of a polymer material such as polycarbonate (PC), polyvinylchloride (PVC) or acrylonitrile butadiene styrene (ABS) for example. Advantageously, the polymer material can be fibre-reinforced, using materials such as glass-fibre, Aramid, Twaron, carbon-fibre or. Kevlar.

The inner shell 3 is considerably thicker and acts as an energy absorbing layer. As such, it is capable of damping or absorbing impacts against the head, it can advantageously be made of foam material like expanded polystyrene (EPS), expanded polypropylene (EPP), expanded polyurethane (EPU), vinyl nitrile foam; or other materials forming a honeycomb-like structure, for example; or strain rate sensitive foams such as marketed under the brand-names Poron™ and D3O™. The construction can be varied in different ways, which emerge below, with, for example, a number of layers of different materials.

Inner shell 3 is designed for absorbing the energy of an impact. Other elements of the helmet 1 will absorb that energy to a limited extent (e.g. the hard outer shell 2 or so-called 'comfort padding' provided within the inner shell 3), but that is not their primary purpose and their contribution to the energy absorption is minimal compared to the energy absorption of the inner shell 3. Indeed, although some other elements such as comfort padding may be made of 'compressible' materials, and as such considered as 'energy absorbing' in other contexts, it is well recognised in the field of helmets that compressible materials are not necessarily 'energy absorbing' in the sense of absorbing a meaningful amount of energy during an impact, for the purposes of reducing the harm to the wearer of the helmet.

As connecting members 5, use can be made of, for example, deformable strips of plastic or metal which are anchored in the outer shell and the inner shell in a suitable manner.

Figure 2:
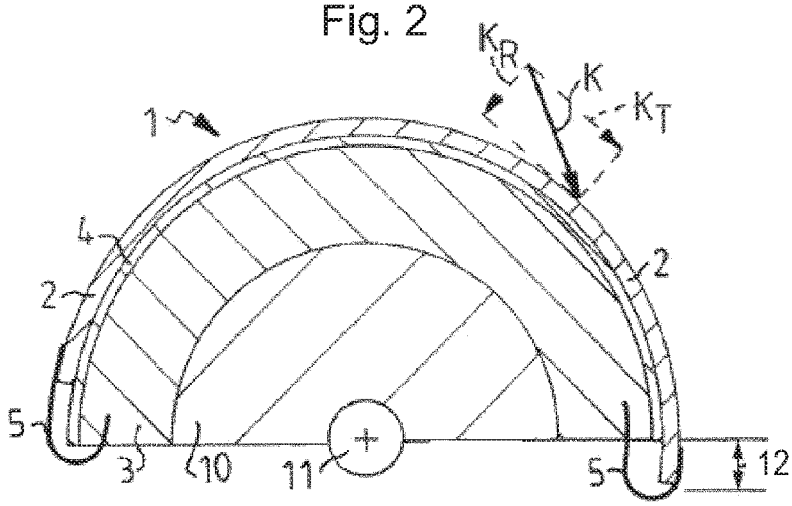
FIG. 2 is a diagram showing the functioning principle of the helmet of FIG. 1.

FIG. 2 shows the functioning principle of protective helmet 1, in which the helmet 1 and a skull 10 of a wearer are assumed to be semi-cylindrical, with the skull 10 being mounted on a longitudinal axis 11. Torsional force and torque are transmitted to the skull 10 when the helmet 1 is subjected to an oblique impact K. The impact force K gives rise to both a tangential force $K_T$ and a radial force $K_R$ against the protective helmet 1. In this particular context, only the helmet-rotating tangential force $K_T$ and its effect are of interest.

As can be seen, the force K gives rise to a displacement 12 of the outer shell 2 relative to the inner shell 3, the connecting members 5 being defamed. A reduction in the torsional force transmitted to the skull 10 of roughly 25% can be obtained with such an arrangement. This is a result of the sliding motion between the inner shell 3 and the outer shell 2 reducing the amount of energy which is transferred into radial acceleration.

Sliding motion can also occur in the circumferential direction of the protective helmet 1, although this is not depicted. This can be as a consequence of circumferential angular rotation between the outer shell 2 and the inner shell 3 (i.e. during an impact the outer shell 2 can be rotated by a circumferential angle relative to the inner shell 3).

Figure 3A:
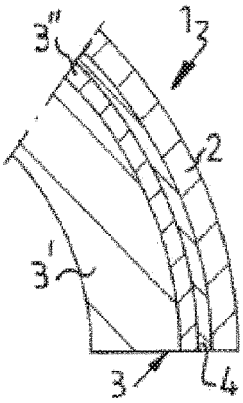
FIGS. 3A, 3B & 3C show variations of the structure of the helmet of FIG. 1.
Figure 3B:
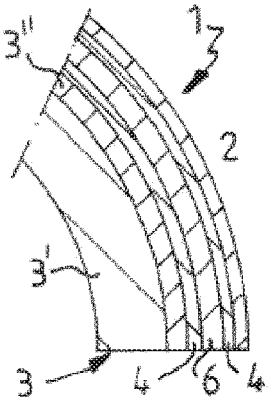
Figure 3C:
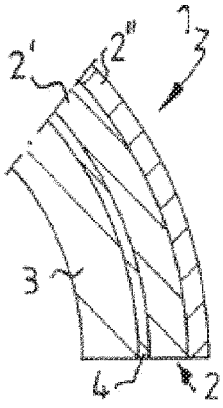

Other arrangements of the protective helmet 1 are also possible. A few possible variants are shown in FIG. 3. In FIG. 3*a*, the inner shell 3 is constructed from a relatively thin outer layer 3" and a relatively thick inner layer 3'. The outer layer 3" is preferably harder than the inner layer 3', to help facilitate the sliding with respect to outer shell 2. In FIG. 3*b*, the inner shell 3 is constructed in the same manner as in FIG. 3*a*. In this case, however, there are two sliding layers 4, between which there is an intermediate shell 6. The two sliding layers 4 can, if so desired, be embodied differently and made of different materials. One possibility, for example, is to have lower friction in the outer sliding layer than in the inner. In FIG. 3*c*, the outer shell 2 is embodied differently to previously. In this case, a harder outer layer 2" covers a softer inner layer 2'. The inner layer 2' tray, for example, be the same material as the inner shell 3.

Figure 4:
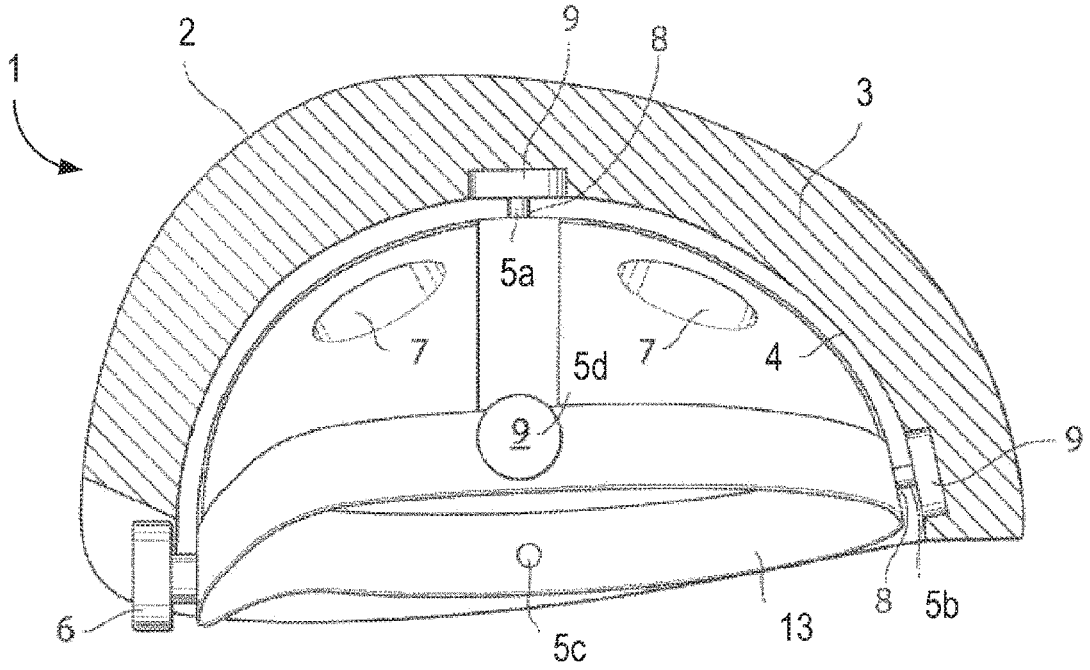
FIG. 4 is a schematic drawing of a another protective helmet.

FIG. 4 depicts a second helmet 1 of the sort discussed in WO 2011/139224, which is also intended for providing protection against oblique impacts. This type of helmet could also be any of the types of helmet discussed above.

In FIG. 4, helmet 1 comprises an energy absorbing layer 3, similar to the inner shell 3 of the helmet of FIG. 1. The outer surface of the energy absorbing layer 3 may be provided from the same material as the energy absorbing layer 3 (i.e. there may be no additional outer shell), or the outer surface could be a rigid shell 2 (see FIG. 5) equivalent to the outer shell 2 of the helmet, shown in FIG. 1. In that case, the rigid shell 2 may be made from a different material than the energy absorbing layer 3. The helmet 1 of FIG. 4 has a plurality of vents 7, which are optional, extending through both the energy absorbing layer 3 and the outer shell 2, thereby allowing airflow through the helmet 1.

An attachment device 13 is provided, for attachment of the helmet 1 to a wearer's head. As previously discussed, this may be desirable when energy absorbing layer 3 and rigid shell 2 cannot be adjusted in size, as it allows for the different size heads to be accommodated by adjusting the size of the attachment device 13. The attachment device 13 could be made of an elastic or semi-elastic polymer material, such as PC, ABS, PVC or PTFE, or a natural fibre material such as cotton cloth. For example, a cap could form the attachment device 13.

Although, the attachment device 13 as shown as comprising a headband portion with further strap portions extending from the front, back, left and right sides, the particular configuration of the attachment device 13 can vary according to the configuration of the helmet. In some cases the attachment device may be more like a continuous (shaped) sheet, perhaps with holes or gaps, e.g. corresponding to the positions of vents 7, to allow air-flow through the helmet.

FIG. 4 also depicts an optional adjustment device 6 for adjusting the diameter of the head band of the attachment device 13 for the particular wearer. In other arrangements, the head band could be an elastic head band in which case the adjustment device 6 could be excluded.

A sliding facilitator 4 is provided radially inwards of the energy absorbing layer 3. The sliding facilitator 4 is adapted to slide against the energy absorbing layer or against the attachment device 13 that is provided for attaching the helmet to a wearer's head.

The sliding facilitator 4 is provided to assist sliding of the energy absorbing layer 3 in relation to an attachment device 13, in the same manner as discussed above. The sliding facilitator 4 creates a low coefficient of friction between the layers on either side of the sliding facilitator 4.

As such, in the FIG. 4 helmet, the sliding facilitator may be provided on or integrated with the innermost sided of the energy absorbing layer 3, facing the attachment device 13.

However, it is equally conceivable that the sliding facilitator 4 may be provided on or integrated with the outer surface of the attachment device 13, for the same purpose of providing slidability between the energy absorbing layer 3 and the attachment device 13. That is, in particular arrangements, the attachment device 13 itself, or an element thereof can be adapted to act as a sliding facilitator 4 and may comprise a low friction material.

In other words, the sliding facilitator 4 is provided radially inwards of the enemy absorbing layer 3. The sliding facilitator can also be provided radially outwards of the attachment device 13.

When the attachment device 13 is formed as a cap (as discussed above), sliding facilitators 4 may be provided as patches of low friction material.

The attachment device 13 can be fixed to the energy absorbing layer 3 and/or the outer shell 2 by means of fixing members 5, such as the four fixing members 5*a*, 5*b*, 5*c* and 5*d* in FIG. 4. These may be adapted to absorb energy by deforming in an elastic, elastic or plastic way. However, this is not essential. Further, even where this feature is present, the amount of energy absorbed is usually minimal in comparison to the energy absorbed by the energy absorbing layer 3 during an impact.

According to the embodiment shown in FIG. 4 the four fixing members 5*a*, 5*b*, 5*c* and 5*d* are suspension members 5*a*, 5*b*, 5*c*, 5*d*, having first and second portions 8, 9, wherein the first portions 8 of the suspension members 5*a*, 5*b*, 5*c*, 5*d* are adapted to be fixed to the attachment device 13, and the second portions 9 of the suspension members 5*a*, 5*b*, 5*c*, 5*d* are adapted to be fixed to the energy absorbing layer 3.

Figure 5:
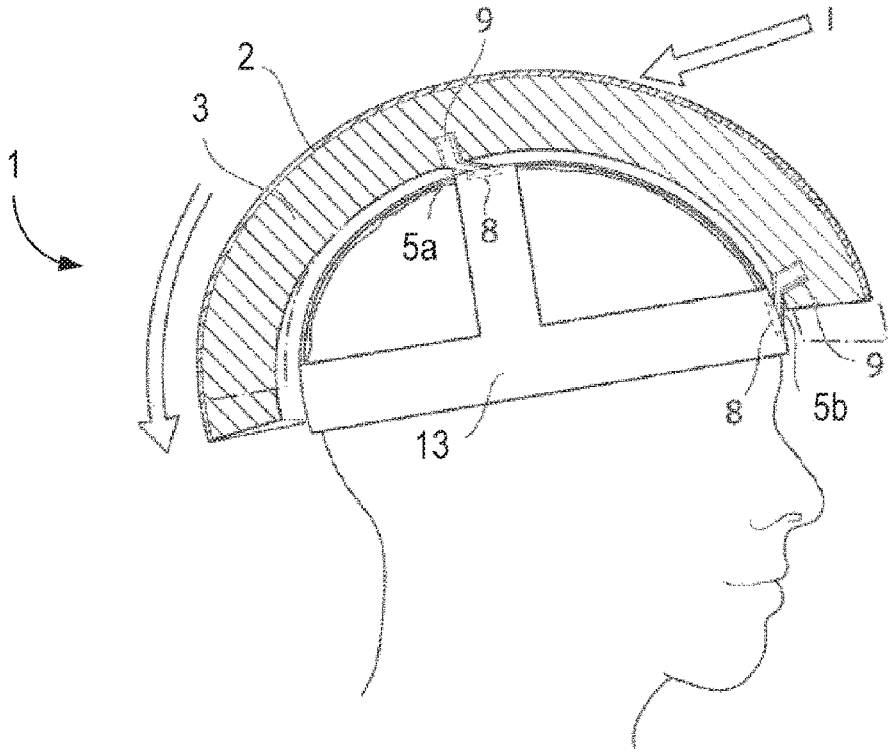
FIG. 5 depicts an alternative way of connecting the attachment device of the helmet of FIG. 4.

FIG. 5 shows an embodiment of a helmet similar to the helmet in FIG. 4, when placed on a wearers' head. The helmet 1 of FIG. 5 comprises a hard outer shell 2 made from a different material than the energy absorbing layer 3. In contrast to FIG. 4, in FIG. 5 the attachment device 13 is fixed to the energy absorbing layer 3 by means of two fixing members 5*a*, 5*b*, which are adapted to absorb energy and forces elastically, semi-elastically or plastically.

A frontal oblique impact I creating a rotational force to the helmet is shown in FIG. 5. The oblique impact I causes the energy absorbing layer 3 to slide in relation to the attachment device 13. The attachment device 13 is fixed to the energy absorbing layer 3 by means of the fixing members 5*a*, 5*b*. Although only two such fixing members are shown, for the sake of clarity, in practice many such fixing members may be present. The fixing members 5 can absorb the rotational forces by deforming elastically or semi-elastically. In other arrangements, the deformation may be plastic, even resulting in the severing of one or more of the fixing members 5. In the case of plastic deformation, at least the fixing members 5 will need to be replaced after an impact. In some case a combination of plastic and elastic deformation in the fixing members 5 may occur, i.e. some fixing members 5 rupture, absorbing energy plastically, whilst other fixing members deform and absorb forces elastically.

In general, in the helmets of FIG. 4 and FIG. 5, during an impact the energy absorbing layer 3 acts as an impact absorber by compressing, in the same way as the inn shell of the FIG. 1 helmet. If an outer shell 2 is used, it will help spread out the impact energy over the energy absorbing layer 3. The sliding facilitator 4 will also allow sliding between the attachment device and the energy absorbing layer. This allows for a controlled way to dissipate energy that would otherwise be transmitted as rotational energy to the brain. The energy can be dissipated by friction heat, energy absorbing layer deformation or deformation or displacement of the fixing members. The reduced energy transmission results in reduced rotational acceleration affecting the brain, thus reducing the rotation of the brain within the skull. The risk of rotational injuries such as subdural haematomas, SDH, blood vessel rapturing, concussions and DAI is thereby reduced.

The sliding facilitator 4 may comprise:

(i) an organic polymer, a polysiloxane and a surfactant;

(ii) an organic polymer and a copolymer based on a polysiloxane and an organic polymer; or (iii) a non-elastomeric cross-linked polymer obtained or obtainable by subjecting a polysiloxane and an organic polymer to a cross-linking reaction.

These three options for the sliding facilitator have been found to be surprisingly effective at lowering the friction between the layers of a helmet that are configured to slide with respect to each other. In particular, each of these specific options (i) to (iii) has been found to provide a coating which has excellent friction reducing properties, and also good durability in terms of how long these properties last. In this regard, the sliding facilitator is able to provide these advantageous properties whilst also providing a good balance in terms of having appropriate adhesion to the underlying layer, while at the same time avoiding significant bleeding of relatively light weight siloxane molecules and/or problems with stickiness that can arise with some silicone-based coatings. In addition, the sliding facilitator employed in the helmet of the present invention leads to advantages in terms of susceptibility to mass production as compared to other systems, such as those employed in existing helmets designed to have good energy-absorption capacity in the case of oblique skull blows.

The advantageous friction lowering properties of the sliding facilitator in the present invention are believed to arise in particular from the presence of siloxane moieties on one or both of the layers configured to slide with respect to each other. The advantageous durability of these properties is believed to arise in particular due to the chemical composition of the sliding facilitator.

In this regard, the sliding facilitator is preferably arranged such that one or both (preferably one) of the surfaces of the layers configured to slide with respect to each other comprises siloxane moieties on the external (or "contact") surface of the layer (i.e. the surface which is in contact with the opposing layer during sliding). Typically said contact surface is based on siloxane, i.e. is substantially composed of siloxane, so as to effectively represent a siloxane coating or layer. In this regard the siloxane moieties may be (or be part of) polysiloxane molecules in the case of option (i) and may be (or be part of) polysiloxane components of the copolymer or cross-linked polymer in the case of option (ii) or (iii).

Thus, in option (i) the sliding facilitator is preferably arranged such that one or both (preferably one) of the contact surfaces of the layers configured to slide with respect to each other is based on polysiloxane molecules; in option (ii) the sliding facilitator is preferably arranged such that one or both (preferably one) of the contact surfaces of the layers configured to slide with respect to each other is based on polysiloxane components of the copolymer molecules; and in option (iii) the sliding facilitator is preferably arranged such that one or both (preferably one) of the contact surfaces of the layers configured to slide with respect to each other is based on polysiloxane components of the cross-linked polymer.

As well as having the sliding facilitator arranged such that one (or both) of the contact surfaces of the layers configured to slide with respect to each other comprises siloxane moieties, it is also preferred that the opposite side of the sliding facilitator (i.e. the "internal" side which remains fixed to or part of the layer itself) comprises organic polymer moieties. In this regard, the sliding facilitator is preferably arranged such that the internal side of the sliding facilitator comprises organic polymer moieties—typically said internal side is based on organic polymer moieties, i.e. is substantially composed of organic polymer moieties, so as to effectively represent an organic polymer coating or layer. The organic polymer moieties may be (or be part of) organic polymer molecules in the case of option (i) or (ii) and may be (or be part of) organic polymer components of the cross-linked polymer in the case of option (iii).

Thus, in option (i) the sliding facilitator is preferably arranged such that the internal side of the sliding facilitator is based on organic polymer molecules; in option (ii) the sliding facilitator is preferably arranged such that the internal side of the sliding facilitator is based on organic polymer molecules; and in option (iii) the sliding facilitator is preferably arranged such that the internal side of the sliding facilitator is based on organic polymer components of the cross-linked polymer.

In one preferred embodiment the sliding facilitator is applied to a solid surface, such as the surface of a sheet plastic layer or a foam layer in the helmet. Such layers could be the outer shell 2, and/or energy absorbing layers 3, and/or the outer surface of an attachment device 13.

In an alternative preferred embodiment, though, the sliding facilitator is not derived entirely from a new layer that is applied as such to a preformed/existing solid surface of a preformed component for the helmet (or a preformed layer for the production thereof, such as a sheet plastic layer or a foam layer). In particular, it is possible for the sliding facilitator to be formed by using an existing surface of a component of the helmet as a source for the organic polymer component of the sliding facilitator (for options (i) and (ii)) or as a source of the organic polymer for cross-linking (in option (iii)). For instance, when the sliding facilitator is defined according to option (i) it may be formed by applying a polysiloxane and a surfactant to a (existing) solid surface (e.g. of a component for the helmet) that is based on an organic polymer; when the sliding facilitator is defined according to option (ii) it may be formed by applying a copolymer based on a polysiloxane and an organic polymer to a (existing) solid surface (e.g. of a component of the helmet) that is based on an organic polymer; and when the sliding facilitator is defined according to option (iii) it may be formed by applying a polysiloxane (typically a functionalized polysiloxane) to a (existing) solid surface (e.g. of a component for the helmet) that is based on an organic polymer and then subjecting the polysiloxane and the organic polymer to a cross-linking reaction. In these instances, it may thus not be appropriate to think of the sliding facilitator as having been applied to a solid surface of the helmet—it may be more appropriate to think of the sliding facilitator as representing a surface region of the layer formed by chemical modification of the previously existing surface part of a layer.

For instance, the existing surface based on an organic polymer could be the surface of a sheet plastic layer or a foam layer in the helmet. Such layers could be the outer shell 2, and/or energy absorbing layers 3, and/or the outer surface of an attachment device 13. Thus, in these cases the sliding facilitator could be formed by chemically modifying a surface of one of these layers using the approach described in the preceding paragraph.

The surface to which the sliding facilitator is applied (or the surface on which the sliding facilitator is formed) is preferably smooth. In contrast, the opposing surface, over which the sliding facilitator improves the slidability, may not be smooth, such as fabric layer.

The sliding facilitator may be applied to (or formed on) the material forming a layer in the helmet before that material has been fully manufactured into the helmet layer. For example, the sliding facilitator may be applied to (or formed on) a plastic sheet before it is cut and/or vacuum formed, for example.

The sliding facilitator may be applied (or formed) as part of a dedicated manufacturing step, or may be included (or formed) in an existing step. For example, if a layer is being printed, e.g. with a pattern or wording, the sliding facilitator could be added to the ink. As such, the sliding facilitator would be applied with the ink in a printing step (e.g. in a screen printing step or other type of printing step). In an alternative approach, if the surface to which the sliding facilitator is to be applied (or formed on), is a material such as polycarbonate which is also to be dyed (i.e. to include a pigment), then the sliding facilitator and dye (pigment) could be combined.

In any event, the end result should be a helmet which comprises within it a sliding facilitator according to one of options (i) to (iii) as set out above.

In embodiments where the sliding facilitator is formed on a surface of a component of the helmet through chemical modification, said surface should preferably be solid, and should of course comprise an organic polymer, and preferably comprise an organic polymer as its predominant component typically the surface will consist essentially of the organic polymer. The preferred arrangement for the sliding facilitator, i.e. with siloxane moieties predominating on the contact surface and organic polymer moieties predominating on the internal surface, will then arise automatically following the introduction of the siloxane-containing components on top of the organic polymer.

In embodiments where the sliding facilitator is applied to a solid surface, in options (i) and (ii) the same preferred arrangement can be achieved e.g. by a process which comprises (a) applying an organic polymer before applying the polysiloxane/copolymer (for option (i)/(ii) respectively) in a separate, later step; or (b) a step in which both the organic polymer and the polysiloxane/copolymer are applied in a single step as part of the same composition, under circumstances that will enable individual molecules of the components of the composition to move or flow. For instance, the composition could comprise a solvent. The molecules have a natural tendency to arrange themselves in the preferred manner under such conditions. In option (i) the surfactant also facilitates the formation of the molecules in the preferred arrangement and the adhesion of the contact surface region of the sliding facilitator (which is typically based predominantly on polysiloxane) with the (internal) organic polymer region of the sliding facilitator. Both approaches (a) and (b) thus essentially result in a sliding facilitator which comprises a (first) sub-layer (which sub-layer may be thought of as e.g. a first coat, coating, covering or surface region) based on organic polymer, and a second sub-layer (which second sub-layer may be thought of as e.g. a second coat, coating, covering or surface region), on said first sub-layer, which second sub-layer comprises the polysiloxane and surfactant. That said, in practice, it is possible for at least a limited amount of intermingling to occur between the first and second sub-layers, particularly with approach (b).

Similarly, in option (iii) the same preferred arrangement can be achieved by a process which comprises (a) applying the organic polymer before applying the polysiloxane in a separate, later step, and then subsequently subjecting the organic polymer and the polysiloxane to a cross-linking reaction; or (b) a step in which both the organic polymer and the polysiloxane are applied in a single step as part of the same composition, under circumstances that will enable individual molecules of the components of the composition to move or flow (for instance, the composition could comprises a solvent; the molecules have a natural tendency to arrange themselves in the preferred manner under such conditions), and then subsequently subjecting the organic polymer and the polysiloxane to a cross-linking reaction.

In embodiments where the sliding facilitator is applied to a solid surface, it is preferable for said solid surface to be based on an organic polymer, preferably an organic polymer that is the same as or comprises the same or similar organic moieties as the organic polymer in the sliding facilitator as defined in option (i) or (ii), or as the organic polymer component of the cross-linked polymer in option (iii). Typically the solid surface consists essentially of the organic polymer.

In a preferred embodiment of the helmet of the present invention, one, and optionally both, of the said two layers are made of foam material, optionally expanded polystyrene (EPS), expanded polypropylene (EPP), expanded polyurethane (EPU), or vinyl nitrile foam. In preferred aspects, the foam may have a density of at least 10 g/l, such as at least 12 g/l, at least 14 g/l, at least 16 g/l, at least 18 g/l or at least 20 g/l. In some preferred aspects the foam may have a density of at least 30 g/l, such as at least 40, at least 50 or at least 60 g/l (e.g. around 65 g/l or more). The density of the foam may be up to e.g. 130 g/l, 120 g/l, 100 g/l or 90 g/l.

As indicated above, the helmet of the present invention comprises:

two layers configured to slide with respect to each other; and wherein the surface of one or both layers comprises a sliding facilitator to improve slidability between the two layers, wherein the sliding facilitator comprises (i) an organic polymer, a polysiloxane and a surfactant;

(ii) an organic polymer and a copolymer based on a polysiloxane and an organic polymer; or (iii) a non-elastomeric cross-linked polymer obtained or obtainable by subjecting a polysiloxane and an organic polymer to a cross-linking reaction.

These options (i) to (iii) for the sliding facilitator are discussed in more detail further below, in turn. In this regard, for the avoidance of doubt, preferred aspects of the sliding facilitator described below are relevant to both the helmet of the invention and also the method (of the invention) of manufacturing said helmet. In particular, preferred aspects described below relating to the nature of the process that may be used to apply certain compositions (including a polysiloxane) to a surface, represent preferred aspects of the step of the above method of the invention which involves applying or forming a sliding facilitator on a surface of a first layer of the helmet. For instance, in the third preferred embodiment described below in connection with option (i), it is indicated that the sliding facilitator is obtained or obtainable by a process which comprises applying to the surface a composition obtainable by mixing certain components (a) to (c). Correspondingly, in the method of the invention, the step of applying or forming a sliding facilitator on a, surface of a first layer of the helmet preferably comprises applying to the surface a composition obtainable by mixing those components (a) to (c).

Option (i): The Sliding Facilitator Comprises an Organic Polymer, a Polysiloxane and Surfactant According to this option the sliding facilitator preferably comprises an organic polymer on the (internal) surface of one or both a said layers. More preferably the sliding facilitator comprises a (first) organic polymer sub-layer (or coating) on said surface, and a second sub-layer (or coating) (on said organic polymer coating) comprising the polysiloxane and surfactant (although in practice it is possible for at least some polysiloxane and/or surfactant to be incorporated within the organic polymer coating, and/or for at least some of the organic polymer to be incorporated within the second coating comprising the polysiloxane and surfactant). Thus, the sliding facilitator preferably has a contact surface based (substantially) on silicon and oxygen which in this option means it is based on polysiloxane molecules. Preferably the contact surface of the sliding facilitator comprises polysiloxane molecules as the main component. Typically the contact surface of the sliding facilitator consists essentially of polysiloxane.

In a first preferred embodiment, the sliding facilitator is obtained or obtainable by a process which comprises applying to said surface a composition comprising the organic polymer, the polysiloxane, the surfactant and optionally at least one solvent (in this case said surface may be a pre-formed structural part of the helmet, or may be e.g. a material destined to become part of the helmet, such as a plastic sheet before it is cut and/or vacuum formed). In this regard, the process may further comprise an additional step in which the composition dries/solidifies (e.g. the applied composition may just be allowed to dry/solidify at room temperature for e.g. 1 to 5 days, and/or drying/solidification may be accelerated e.g. by means of the application of heat and/or reduced pressure)—such that solvent evaporates and a coating comprising the organic polymer, the polysiloxane and the surfactant remains on the surface. Thus, the sliding facilitator is preferably obtained or obtainable by a process which comprises (a) applying to said surface a composition comprising the organic polymer, the polysiloxane, the surfactant and optionally at least one solvent, and optionally (b) allowing the thus applied, composition to dry/solidify.

In relation to the above process, preferably the organic polymer and at least one (of said at least one or more)

solvents together account for at least 60% by weight of the composition, more preferably at least 80% by weight, and more preferably still at least 90% by weight. The organic polymer and solvent together may account for up to 99% by weight of the composition, such as up to 98% by weight, or up to 97% by weight. Typically the organic polymer and solvent together account for around 95% by weight of the composition. The relative amounts of organic polymer and solvent are preferably such that there is sufficient solvent to dissolve the organic polymer (e.g. at standard pressure and temperature). The organic polymer may account for at least 1% by weight of the composition, such as at least 2% by weight, at least 5% by weight, at least 10% by weight, or at least 20% by weight.

In relation to the above process, preferably the polysiloxane, surfactant and optionally at least one (further) solvent together account for at least 1% by weight of the specified composition, more preferably at least 2% by weight, and more preferably still at least 3% by weight. The polysiloxane, surfactant and optionally at least one (further) solvent together may account for up to 40% by weight of the composition, such as up to 20% by weight, or up to 10% by weight. Typically the polysiloxane, surfactant and optionally at least one (further) solvent together account for around 5% by weight of the composition. The weight ratio of polysiloxane:surfactant is preferably X:1 wherein X is at least 10, such as at least 20, at least 50, at least 100, at least 200, at least 500, at least 1000, at least 2000, or at least 5000. X may be up to 1,000,000, such as up to 500,000, up to 200,000, up to 100,000, up to 50,000, up to 20,000 or up to 10,000. The polysiloxane may account for at least 0.1% by weight of the composition, such as at least 0.2% by weight, at least 0.5% by weight, at least 1% by weight, or at least 2% by weight.

In a second preferred embodiment, the sliding facilitator is obtained or obtainable by a process which comprises applying to a solid (pre-formed) organic polymer surface (or layer) a composition comprising the polysiloxane, the surfactant and optionally a solvent (in this case the solid organic polymer may be a pre-formed structural part of the helmet, or may be e.g. a material destined to become part of the helmet, such, as a plastic sheet before it is cut and/or vacuum formed). In this regard, the process may further comprise an additional step in which the composition dries/solidifies (e.g. the applied composition may just be allowed to dry/solidify at room temperature, e.g. for 1 to 5 days, and/or drying/solidification may be accelerated by means of e.g. the application of heat and/or reduced pressure)—such that solvent evaporates and a coating comprising the polysiloxane and the surfactant remains on the organic polymer surface. Thus, in this embodiment the sliding facilitator is preferably obtained or obtainable by a process which comprises applying to a solid organic polymer surface (or layer) a composition comprising the polysiloxane, the surfactant and optionally at least one solvent, and optionally (b) allowing the thus applied composition to dry/solidify.

In this second preferred embodiment, preferably the polysiloxane, surfactant and optionally at least one (further) solvent together account for at least 50% by weight of the specified composition, more preferably at least 70% by weight, and more preferably still at least 90% by weight (typically the polysiloxane, surfactant and optionally at least one (further) solvent together account for at least 98% by weight, or substantially all of the composition). The weight ratio of polysiloxane:surfactant is preferably X:1 wherein X is at least 10, such as at least 20, at least 50, at least 100, at least 200, at least 500, at least 1000, at least 2000, or at least 5000. X may be up to 1,000,000, such as up to 500,000, up to 200,000, up to 100,000, up to 50,000, up to 20,000 or up to 10,000. The polysiloxane may account for at least 0.1% by weight of the composition, such as at least 0.2% by weight, at least 0.5% by weight, at least 1% by weight, or at least 2% by weight (and up to e.g. 10 or 20 or 50% by weight, or more).

In a third preferred embodiment, which is particularly advantageous, the sliding facilitator is obtained or obtainable by a process which comprises applying to said surface a composition comprising one or more precursors for the organic polymer, the polysiloxane, the surfactant and optionally (preferably) at least one solvent (said surface may be a pre-formed structural part of the helmet, or may be e.g. a material destined to become part of the helmet, such as a plastic sheet before it is cut and/or vacuum formed). In this regard, the process may further comprise an additional step in which the composition dries/solidifies (e.g. the applied composition may just be allowed to dry/solidify at room temperature for e.g. up to 1 day, or longer such as up to 5 days, and/or drying/solidification may be accelerated e.g. by means of the application of heat and/or reduced pressure)—such that solvent evaporates and a coating comprising the organic polymer, the polysiloxane and the surfactant remains on the surface. Thus, the sliding facilitator is preferably obtained or obtainable by a process which comprises (a) applying to said surface a composition comprising one or more precursors for the organic polymer, the polysiloxane, the surfactant and optionally (preferably) at least one solvent, and optionally (b) allowing the thus applied composition to dry/solidify.

In relation to the above process, preferably said one or more precursors for the organic polymer account for at least 15% by weight of the composition, more preferably at least 20% by weight, yet more preferably at least 25% by weight, and more preferably still at least 30% by weight. Said one or more precursors for the organic polymer may preferably account for up to 70% by weight of the composition, such as up to 60% by weight, or up to 50% by weight. Typically said one or more precursors for the organic polymer account for around 30% to 45% by weight, of the composition.

In relation to the above process, preferably the polysiloxane and surfactant together account for at least 1% by weight of the specified composition, more preferably at least 2% by weight, and more preferably still at least 3% by weight. The polysiloxane and surfactant together may preferably account for up to 20% by weight of the composition, such as up to 15% by weight, up to 10% by weight, up to 8% by weight, up to 6% by weight or up to 5% by weight. Typically the polysiloxane and surfactant together account for around 3% to 5% by weight of the composition, such as around 3%, around 4% or around 5% by weight. The weight ratio of polysiloxane:surfactant is preferably X:1 wherein X is at least 10, such as at least 20, at least 50, at least 100, at least 200, at least 500, at least 1000, at least 2000, or at least 5000. X may be up to 1,000,000, such as up to 500,000, up to 200,000, up to 100,000, up to 50,000, up to 20,000 or up to 10,000. The polysiloxane may account for at least 0.1% by weight of the composition, such as at least 0.2% by weight, at least 0.5% by weight, at least 1% by weight, at least 2% by weight or at least 3% by weight.

In relation to the above process, preferably said at least one solvent accounts for at least 15% by weight of the composition, more preferably at least 20% by weight, yet more preferably at least 25% by weight, and more preferably still at least 30% by weight. The at least one solvent may preferably account for up to 70% by weight of the composition, such as up to 60% by weight, or up to 50% by weight.

Typically the at least one solvent accounts for around 30% to 45% by weight of the composition.

In relation to the above process, the composition may typically also comprise one or more further components, such as pigments and/or silicon ketone additives. The composition may comprise additive organic silicon.

In a fourth preferred embodiment, the sliding facilitator is obtained or obtainable by process which is the same as that outlined above in the third preferred embodiment, except that said one or more precursors for the organic polymer are replaced by a resin, such as a polyurethane resin. Other preferred aspects of the third preferred embodiment described herein apply similarly to this fourth preferred embodiment subject to that exception.

In the process of the first preferred embodiment, typically the composition is obtained or obtainable by mixing (a) a first reagent comprising the organic polymer and optionally at least one solvent, and (b) a second reagent comprising the polysiloxane, the surfactant and optionally at least one (further) solvent. Thus, the composition may comprise a mixture of two or more solvents. In any case, the solvents may include organic and/or aqueous solvents. Preferred organic solvents (in particular for the first reagent) include alkyl esters such as butyl or amyl acetate, ketones such as acetone, methyl isobutyl ketone or cyclohexanone, aromatic hydrocarbons such as xylene, ethers such as glycol cellosolves, alcohols, and mixtures thereof. Typically said at least one solvent includes an aqueous solvent, preferably water (said at least one solvent in the above mentioned second reagent is preferably water).

In the process of the third preferred embodiment, preferably the precursors for the organic polymer may be monomeric and/or oligomeric precursors. In a particularly preferred embodiment the precursors for the organic polymer comprise one or more monomers (and/or oligomers derived therefrom) selected from monomers having the formula R—C(═O)—OR', wherein R and R' are the same or different and are independently hydrogen or hydrocarbyl groups having up to 10 carbon atoms, preferably up to 8 carbon atoms, more preferably up to 6 carbon atoms, such as up to 5 carbon atoms or up to 4 carbon atoms, subject to the requirement that at least one of R and R' is a hydrocarbyl group containing an alkene moiety (typically one of R and R' contains an alkene moiety and the other one does not). Preferred options for the monomers include acrylic acid and esters thereof, methacrylic acid and esters of thereof, and compounds of the above formula wherein R is alkyl (e.g. $C_{1-6}$alkyl) and R' is $C_{2-4}$alkenyl (e.g. vinyl). Particularly preferred options for the monomers and/or oligomers derived therefrom are selected from chloride vinyl acetate, methacrylate, acetate butyrate, PVCA and resin acrylic.

In the process of the third preferred embodiment, preferably said at least one solvent is at least one organic solvent. Preferred options include ethylene glycol butyl ether, cyclohexanone, xylene, trimethylbenzene (e.g. mesitylene), isophorone, and butoxyethanol.

In a particularly preferred aspect of the third preferred embodiment, the sliding facilitator is obtained or obtainable by a process which comprises applying to said surface a composition obtainable by mixing (a) an agent comprising one or more precursors for the organic polymer plus one or more a solvents, (h) an agent comprising a polysiloxane, a surfactant and optionally (preferably) at least one solvent, and (c) at least one further solvent (said surface may be a pre-formed structural part of the helmet, or may be e.g. a material destined to become part of the helmet, such as a plastic sheet before it is cut and/or vacuum formed). In this regard, the process may further comprise an additional step in which the composition dries/solidifies (e.g. the applied composition may just be allowed to dry/solidify at room temperature for e.g. up to 1 day, or longer such as up to 5 days, and/or drying/solidification may be accelerated e.g. by means of the application of heat and/or reduced pressure)—such that solvent evaporates and a coating comprising the organic polymer, the polysiloxane and the surfactant remains on the surface. The organic polymer is preferably a thermoplastic polymer.

The organic polymer is preferably a lacquer.

Typically, the organic polymer is obtained or obtainable by a process which comprises applying to said surface a varnish, i.e. a solution in which the organic polymer is dissolved.

The organic polymer may comprise, for example, one or more selected from polyether (e.g. poly(ethylene oxide), poly(proplene oxide)), polyester, polyolefin (e.g. polyethylene, polypropylene, polyisobutylene), polyurethane, polyacrylate, polymethacrylate, polyepoxide, poly(methyl methacrylate), polyacrylonitrile, polyamide, polyacrylamide, polyimide, poly(ethyleneimine), polyphosphazine, polyvinyl acetate, polyvinyl chloride, polystyrene, poly(vinylidene chloride), polyisoprene and alkyd. Preferably the organic polymer comprises a mixture of one or more thereof. Typically the organic polymer comprises a mixture, e.g. a mixture of blended polymer resins. Suitable organic polymers are commercially available.

For the avoidance of doubt, the organic polymer in option (i) should not be a cross-linked polymer (this is true generally for all references to polymers herein, including references to organic polymers, polysiloxanes and copolymers, unless indicated otherwise).

The organic polymer may preferably be a polymer obtained or obtainable by polymerising one or more monomers and/or oligomers, including one or more monomers (and/or oligomers derived therefrom) having the formula R—C(═O)—OR', wherein R and R' are the same or different and are independently hydrogen or hydrocarbyl having up to 10 carbon atoms, preferably up to 8 carbon atoms, more preferably up to 6 carbon atoms, such as up to 5 carbon atoms or up to 4 carbon atoms, subject to the requirement that at least one of R and R' is a hydrocarbyl group containing an alkene moiety (typically one of R and R' contains an alkene moiety and the other one does not and is e.g. an alkyl group). Preferred options for the monomers include acrylic acid and esters thereof, methacrylic acid and esters of thereof, and compounds of the above formula wherein R is alkyl (e.g. $C_{1-6}$alkyl) and R' is $C_{2-4}$alkenyl (e.g. vinyl). Particularly preferred options for the monomers and/or oligomers derived therefrom, are selected from chloride vinyl acetate, methacrylate, acetate butyrate, PVCA and resin acrylic. For instance, the organic polymer may be obtainable by polymerising (a) chloride vinyl acetate, methacrylate, and acetate butyrate, e.g. in respective ratios of 1:(0.2-5):(0.2-5) (preferably 1:(0.5-3):(0.5-3)); or (b) PVCA and resin acrylic, e.g. in respective ratios of 1:(0.2-5) (preferably 1:(0.5-2)). The polysiloxane may comprise linear, branched and/or cyclic molecules.

The linear polysiloxane molecules are preferably of formula $R_3Si[—O—SiR_2]_n—O—SiR_3$.

The moiety n may have a value up to e.g. 135,000, such as up to 100,000, up to 50,000, or up to 20,000. Preferably n is at least 70, such as at least 100, at least 200, at least 500, or at least 1,000.

Typically each R is other than H. Preferably each R is independently a hydrocarbyl group. Said hydrocarbyl group is based on carbon and hydrogen but may optionally comprise one or more other atoms such as N, O, S and halogen (provided that they do not compromise the role of the polysiloxane in the sliding facilitator). Preferably said other atom is O. If any of said other atoms are present, the ratio of carbon atoms to said other atoms in the R group is preferably X:1 wherein X is at least 2, preferably at least 4, more preferably at least 8. Typically, though, each R is independently a hydrocarbyl group based on carbon and hydrogen only.

Said hydrocarbyl group preferably comprises 1 to 30 carbon atoms, more preferably 1 to 20 carbon atoms, and yet more preferably 1 to 10 carbon atoms, such as 0.1 to 6 carbon atoms, R may be cyclic (either aromatic, e.g. phenyl, or non-aromatic), straight or branched. Typically R is a straight or branched alkyl group containing 1 to 10 carbon atoms, preferably 1 to 6 carbon atoms, and more preferably 1 to 4 carbon atoms. Typical examples include methyl, ethyl, n-propyl, i-propyl, n-butyl, i-butyl and t-butyl, with methyl and ethyl being preferred, and methyl being most preferred.

The branched polysiloxane molecules are preferably of formula $R_3Si[—O—SiR_2]_n—O—SiR_3$ wherein R and n are as defined above (for the linear polysiloxane molecules) subject to the proviso that one or more of the R groups in one or more of the repeated $[—O—SiR_2]$ units is not as defined above, but rather is of formula $[—O—SiR_2]_n—O—SiR_3$ (with R and n in this latter formula being defined in the same way as in the former formula). In this regard, naturally the degree of branching possible will vary depending on the nature of the polymer so this definition does not seek to introduce an arbitrary upper limit—the skilled person will appreciate what levels of branching may be possible in a given instance. That said, preferably R and n in this latter formula are as defined above for the linear polysiloxane molecules.

The cyclic polysiloxane molecules are preferably linear polysiloxane molecules as defined above subject to the inclusion of one or more cyclic siloxane moieties in the molecule.

The polysiloxane is preferably polydimethylsiloxane (PDMS).

The number average molecular weight of the polysiloxane is preferably at least 5,000, more preferably at least 10,000, yet more preferably at least 20,000, yet more preferably at least 50,000. As regards possible upper limits for the number average molecular weight, usually it is no more than 10,000,000, preferably no more than 5,000,000, more preferably no more than 2,000,000, and typically no more than 1,000,000. It is particularly preferred for the polysiloxane to be an ultra high molecular weight polysiloxane, i.e. with a number average molecular weight of at least 100,000, such as at least 200,000, or at least 500,000.

It is possible for the polysiloxane to be functionalised, i.e. to include one or more functional groups with a view to facilitating further reaction. Possible functional groups that may be incorporated in this regard include silane, alkenyl, hydroxyl, carboxyl, epoxy, methacrylate, acrylate, amino and thiol. In this regard the functional group is preferably hydroxyl, and in particular hydroxyl in the form of a silanol (Si—OH) group. In another embodiment, though, the polysiloxane has not been functionalised to incorporate any functional groups in this way, i.e. the polysiloxane does not include any such additional functional groups (or, if any functional groups are present, they are silanol groups). In this embodiment, the polysiloxane (typically PDMS) may be thought of as being in non-reactive form, i.e. wherein substantially all polymeric chain termini have the structure $—O—Si(R)_3$ (wherein R is as defined above, and is of course methyl in the preferred case of PDMS).

The polysiloxane may be prepared by known methods, as described e.g. in "Silicones: Preparation, Properties and Performance" by André Colas, Dow Corning, Life Sciences, 2005, Form No. 01-3077-01. Also, suitable substances (comprising polysiloxanes) may be obtained commercially, e.g. the Dow Corning® 52 (DC52) additive product contains the preferred ultra high molecular weight polysiloxane mentioned above.

The surfactant is preferably a non-ionic surfactant, more preferably an organic non-ionic surfactant. In a particularly preferred aspect, the surfactant is a fatty alcohol alkoxylate, preferably one of formula $R'—[O-Q-]_mOH$, wherein m, Q and R' are defined as follows.

m is 1 to 20, preferably 1 to 10. In practice there will typically be a mixture of alkoxylates with differing numbers of [O-Q-] units within the specified range.

Q is a divalent hydrocarbyl moiety containing 1 to 10 carbon atoms (preferably this hydrocarbyl group comprises carbon and hydrogen only), more preferably 1 to 4 carbon atoms, and typically 2 carbon atoms. Preferably Q is alkylene. Thus, the surfactant is preferably a fatty alcohol ethoxylate of formula $R'—[O—CH_2—CH_2-]_mOH$.

R' is a hydrocarbyl group containing 6 to 22 carbon atoms (preferably this hydrocarbyl group comprises carbon and hydrogen only). In this regard the hydrocarbyl group preferably contains at least 8 carbon atoms, more preferably at least 10 carbon atoms, and typically at least 11 carbon atoms. Also in this regard, the hydrocarbyl group preferably contains at most 20 carbon atoms, more preferably at most 18 carbon atoms, yet more preferably at most 16 carbon atoms, and typically at most 15 carbon atoms. In practice there will typically be a mixture of alkoxylates with differing sizes of R' group within the specified range.

The hydrocarbyl group R' may be branched or unbranched, saturated or unsaturated, and may contain one or more cyclic groups, which cyclic groups may be aromatic or non-aromatic. Preferably, though, R' is aliphatic.

R' may be defined such that R'—OH is a primary, secondary or tertiary alcohol. Preferably, though, R' is defined such that R'—OH is a secondary alcohol.

Thus, in, a particularly preferred embodiment, the fatty alcohol ethoxylate is a mixture of ethoxylated $C_{11}$ to $C_{15}$ secondary alcohols.

In option (i) the sliding facilitator preferably comprises (and more preferably is) a coating (preferably a coating that is obtainable by a process of printing a lacquer-based composition onto a solid surface, e.g. by screen printing), wherein preferably (a) the organic polymer accounts for at least 85%, such as at least 88%, at least 90% or at least 92% by weight of the coating, (b) the organic polymer accounts for up to 98%, such as up to 97%, or up to 96% by weight of the coating, (c) the polysiloxane accounts for at least 1%, such as at least 2%, at least 3% or at least 4% by weight of the coating, (d) the polysiloxane accounts for up to 10%, such as up to 8%, or up to 6% by weight of the coating, (e) the surfactant accounts for at least 0.1%, such as at least 0.2%©, at least 0.3% or at least 0.4% by weight of the coating, and/or (f) the surfactant accounts for up to 1.5%, Such as up to 1.2%, or up to 1.0% by weight of the coating. The coating may optionally also comprise one or more further components, such as pigments.

Option (ii): The Sliding Facilitator Comprises an Organic Polymer and a Copolymer Based on a Polysiloxane and an Organic Polymer According to this option the sliding facilitator preferably comprises an organic polymer on the (internal) surface of one or both of said layers. More preferably the sliding facilitator comprises a (first) organic polymer sub-layer (or coating) on said surface, and a second sub-layer (or coating) (on said organic polymer coating) comprising the copolymer (although in practice it is possible for at least some copolymer to be incorporated within the organic polymer coating, and/or for at least some of the organic polymer to be incorporated within the second coating comprising the copolymer). Thus, the sliding facilitator preferably has a contact surface based (substantially) on silicon and oxygen which in this option means it is based on polysiloxane components of copolymer molecules. Preferably the contact surface of the sliding facilitator comprises polysiloxane moieties as the main component. Typically the contact surface of the sliding facilitator consists essentially of polysiloxane moieties.

In a first preferred embodiment, the sliding facilitator is obtained or obtainable by a process which comprises applying to said surface a composition comprising the organic polymer, the copolymer and optionally at least one solvent (in this case said surface may be a pre-formed structural part of the helmet, or may be e.g. a material destined to become part of the helmet, such as a plastic sheet before it is cut and/or vacuum formed). In this regard, the process may further comprise an additional step in which the composition dries/solidifies (e.g. the applied composition may just be allowed to dry/solidify at room temperature e.g. for 1 to 5 days, and/or drying/solidification may be accelerated e.g. by means of the application of heat and/or reduced pressure)—such that solvent evaporates and a coating comprising the organic polymer and the copolymer remains on the surface. Thus, the sliding facilitator is preferably obtained or obtainable by a process which comprises (a) applying to said surface a composition comprising the organic polymer, the copolymer and optionally at least one solvent, and optionally (b) allowing the thus applied composition to dry/solidify.

In relation to the above process, preferably the organic polymer and at least one (of said at least one or more) solvents together account for at least 60% by weight of the composition, more preferably at least 80% by weight, and more preferably still at least 90% by weight. The organic polymer and solvent together may account for up to 99% by weight of the composition, such as up to 98% by weight, or up to 97% by weight. Typically the organic polymer and solvent together account for around 95% by weight of the composition. The relative amounts of organic polymer and solvent are preferably such that there is sufficient solvent to dissolve the organic polymer (e.g. at standard pressure and temperature). The organic polymer may account for at least 1% by weight of the composition, such as at least 2% by weight, at least 5% by weight, at least 10% by weight, or at least 20% by weight.

In relation to the above process, preferably the copolymer and optionally at least one (further) solvent together account for at least 1% by weight of the specified composition, more preferably at least 2% by weight, and more preferably still at least 3% by weight. The copolymer and optionally at least one (further) solvent together may account for up to 40% by weight of the composition, such as up to 20% by weight, or up to 10% by weight. Typically the copolymer and optionally at least one (further) solvent together account for around 5% by weight of the composition. The copolymer may account for at least 0.1% by weight of the composition, such as at least 0.2% by weight, at least 0.5% by weight, at least 1% by weight, or at least 2% by weight.

In a second preferred embodiment, the sliding facilitator is obtained or obtainable by a process which comprises applying to a solid (pre-formed) organic polymer surface (or layer) a composition comprising the copolymer and optionally a solvent (in this case the solid organic polymer may be a pre-formed structural part of the helmet, or may be e.g. a material destined to become part of the helmet, such as a plastic sheet before it is cut and/or vacuum formed). In this regard, the process may further comprise an additional step in which the composition dries/solidifies (e.g. the applied composition may just be allowed to dry/solidify at room temperature, e.g. for 1 to 5 days, and/or drying/solidification may be accelerated by means of e.g. the application of heat and/or reduced pressure)—such that solvent evaporates and a coating comprising the copolymer remains on the organic polymer surface. Thus, in this embodiment the sliding facilitator is preferably obtained or obtainable by a process which comprises applying to a solid organic polymer surface (or layer) a composition comprising the copolymer and optionally at least one solvent, and optionally (b) allowing the thus applied composition to dry/solidify.

In this second preferred embodiment, preferably the copolymer and optionally at least one (further) solvent together account for at least 50% by weight of the specified composition, more preferably at least 70% by weight, and more preferably still at least 90% by weight (typically the copolymer and optionally at least one (further) solvent together account for at least 98% by weight, or substantially all of the composition). The copolymer may account for at least 0.1% by weight of the composition, such as at least 0.2% by weight, at least 0.5% by weight, at least 1% by weight, or at least 2% by weight (and up to e.g. 10, 20, 50 or even 100% by weight).

In the process of the first preferred embodiment, typically the composition is obtained or obtainable by mixing (a) a first reagent comprising the organic polymer and optionally at least one solvent, and (b) a second reagent comprising the copolymer and optionally at least one (further) solvent. Thus, the composition may comprise a mixture of two or more solvents. In any case, the solvents may include organic and/or aqueous solvents (e.g. water). Preferably the solvents comprise organic solvents (and preferably not water). Preferred organic solvents (in particular for the first reagent) include alkyl esters such as butyl or amyl acetate, ketones such as acetone, methyl isobutyl ketone or cyclohexanone, aromatic hydrocarbons such as xylem, ethers such as glycol cellosolves, alcohols, and mixtures thereof.

Further, possible solvents (in particular for the second reagent) may include water, an ether or an ester. Suitable examples of ethers include glycol ethers such as 2-methoxyethanol, 2-ethoxyethanol, 2-propoxyethanol, 2-isopropoxyethanol, 2-butoxyethanol, 2-phenoxyethanol, 2-benzyloxyethanol, 2-(2-methoxyethoxy)ethanol, 2-(2 ethoxyethoxy) ethanol, and 2-(2-butoxyethoxy)ethanol; and dialkyl ethers such as dimethoxyethane, diethoxyethane, and dibutoxyethane. Examples of esters include 2-methoxyethyl acetate, 2-ethoxyethyl acetate, 2-butoxyethyl acetate, and 1-methoxy-2-propanol acetate. The preferred solvent is 2-isopropoxyethanol (particularly for the second reagent when the organic polymer is a polysiloxane polyether copolymer containing carbinol groups).

In one embodiment, the second reagent is substantially free of solvent.

Preferred aspects of the organic polymer component of the sliding facilitator in option (ii) are the same as those defined above for the organic polymer component in option (i). As for the copolymer component of the sliding facilitator in option (ii), and the organic polymer on which (together with a polysiloxane) said copolymer component of option (ii) is based, preferred aspects of these are discussed below.

The copolymer based on a polysiloxane and an organic polymer preferably has separate hydrophilic (organic polymer) and hydrophobic (polysiloxane) parts. Thus, preferably the copolymer is a block copolymer, i.e. it comprises two or more homopolymer subunits linked by covalent bonds. The copolymer is preferably non-ionic.

The organic polymer may be a polyether (e.g. poly (ethylene oxide), poly(proplene oxide)), polyester, polyolefin (e.g. polyethylene, polypropylene, polyisobutylene), polyurethane, polyacrylate, polymethacrylate, polyepoxide, poly(methyl methacrylate), polyacrylonitrile, polyamide, polyacrylamide, polyimide, poly(ethyleneimine), polyphosphazine, polyvinyl acetate, polyvinyl chloride, polystyrene, poly(vinylidene chloride), polyisoprene, alkyd, polytetrafluoroethylene, or a mixture of two or more thereof.

Preferably the organic polymer a polyether, in which case the copolymer is a polysiloxane polyether copolymer. In this regard, the polyether component of the polysiloxane polyether copolymer is preferably a polymer of ethylene oxide, propylene oxide, or a mixture of ethylene oxide and propylene oxide.

The polysiloxane component of the copolymer is (independently) preferably a linear, branched or cyclic polysiloxane as defined above in option (i) (subject of course to appropriate structural adjustment to its valency, so as to accommodate the formation in this latter instance of one or more bonds to one or more organic polymer components), except that in this instance the number average molecular weight of the polysiloxane is preferably at least 150, more preferably at least 500, such as at least 1,000 or at least 2,000. As regards possible upper limits for the number average molecular weight, usually it is no more than 500,000, preferably no more than 100,000, more preferably no more than 50,000, such as no more than 20,000, no more than 10,000, or no more than 5,000. Most preferably the polysiloxane component of the copolymer is (based on) PDMS.

Examples of possible structures for the polysiloxane polyether copolymer (using a PDMS structure, for simplicity) are set out below.

Formula I

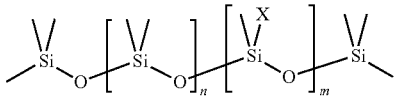

X = -alkylene-(O-alkylene-)$_y$O—R

Formula II

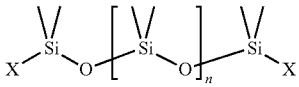

X = -alkylene-(O-alkylene-)$_y$O—R

Formula III

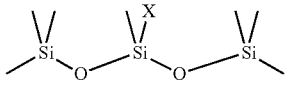

X = -alkylene-(O-alkylene-)$_y$O—R

In formulae I to III the alkylene moieties are each independently preferably selected from ethylene and propylene. The propylene may be iso-propylene or n-propylene. Preferably it is n-propylene. Preferably X is —$(CH_2)_3$—(O—$CH_2$—$CH_2$-)$_y$O—R.

The moiety R in group X is defined in the same way as above for the linear polysiloxanes. Thus, preferably each R is independently a hydrocarbyl group based on carbon and, hydrogen only, and typically is a straight or branched alkyl group containing 1 to 10 carbon atoms, with examples being methyl, ethyl, n-propyl, i-propyl, n-butyl, and t-butyl, with methyl and ethyl being preferred (although in this case ethyl may be most preferred).

The moieties n and y may vary depending of course on what is desired in terms of the molecular weight of the copolymer and the relative proportions of the respective repeated units:

- m is preferably at least 1, preferably at least 2, more preferably at least 3, such as at least 4, at least 5, or at least 6; and m may by up to 200, more preferably up to 100, such as up to 80, up to 60, up to 40 or up to 20;
- n is preferably at least 1, preferably at least 2, more preferably at least 3, such as at least 4, at least 5, or at least 6; and n may by up to 200, more preferably up to 100, such as up to 80, up to 60, up to 40 or up to 20;
- for the avoidance of doubt, in formula I it is not required that all of the —[Si(Me)$_2$-O—]$_n$ structural units to be adjacent to each other in a single block, attached to another single block of adjacent —[Si(Me)(X)—O—]$_n$, structural units—thus, it is possible for the —[Si(Me)$_2$-O—] and —[Si(Me)(X)—O—] structural units to be interspersed;
- y is preferably at least 1, preferably at least 2, more preferably at least 3, such as at least 4, at least 5, or at least 6; and m may by up to 200, more preferably up to 100, such as up to 80, up to 60, up to 40 or up to 20;

The weight ratio of polysiloxane component:organic polymer component in the copolymer is not specifically limited. It may be e.g. A:1 wherein A is at least 0.001, preferably at least 0.01, such as at least 0.1, at least 0.2, or at least 0.5; and/or wherein A is 1000 or less, preferably 100 or less, such as 10 or less, or 5 or less.

The organic polymer (preferably a polyether) can be attached to a side chain of a polysiloxane backbone through a hydrosilylation or condensation process, and can form a variety of different structures, as illustrated for polysiloxane polyether copolymers by Formulae I to III above. Thus, Formula I allows for a molecular structure which may be termed "rake type" due to the possibility of having multiple polyether sidechains off the polysiloxane backbone; Formula II allows for an "ABA" type structure, i.e. with a polysiloxane subunit in between two polyether subunits; and Formula III allows for a trisiloxane group attached to a polyether subunit.

There is flexibility in designing these copolymers using known methodology they can be varied in terms of molecular weight, molecular structure (pendant/linear), composition of the organic polymer chain (e.g. ethylene vs propylene in the case where the organic polymer is polyether), and ratio of polysiloxane to organic polymer. Increasing the molecular weight of the copolymer generally increases its viscosity.

The number average molecular weight of the copolymer is preferably at least 500, more preferably at least 1,000, yet more preferably at least 2,000, and in some embodiments preferably at least 5,000. As regards possible upper limits for the number average molecular weight, usually it is no more than 500,000, preferably no more than 200,000, more preferably no more than 100,000. In some cases the upper limit may be relatively low, e.g. around 20,000, or around 10,000, or even around 5,000. Typically, though, the upper limit is higher than that, e.g. around 100,000 or 50,000.

It is possible for the copolymer to be functionalised, i.e. to include one or more functional groups. Possible functional groups that may be incorporated in this regard include silane, alkenyl, hydroxyl, carboxyl, epoxy, methacrylate, acrylate, amino or thiol. In this regard the functional group is preferably hydroxyl, and in particular hydroxyl in the form of a carbinol (—$CH_2$—OH) group. In another preferred embodiment, though, the copolymer has not been functionalised to incorporate any functional groups in this way, i.e. the copolymer does not include any additional functional groups (beyond the groups present in the regular polysiloxane and organic polymer subunits and the points at which they are connected). In this embodiment the copolymer may be described as non-reactive.

The copolymer may be prepared by known methods—e.g. as noted above organic polymer groups can be attached to a side chain of a siloxane backbone through a hydrosilylation or condensation process. Also, suitable copolymers are available commercially, e.g. the Dow Corning® 57 or Dow Corning® 205SL additive products may be used to provide suitable polysiloxane polyether copolymers.

Possible Further Component for Use in Option (i) and (ii)

As mentioned above, the options (i) to (iii) for the sliding facilitator have been found to provide a coating which has excellent friction reducing properties, but also good durability in terms of how long these properties last. In this regard, in options (i) and (ii) it is believed that one of the ways in which durability of the friction reducing properties is enhanced relates to the fact that the structures may enable the migration of polysiloxane moieties to the surface so as to replace polysiloxane moieties that may be lost. In other words, options (i) and (ii) may enable the friction reducing properties to be continually replenished if/when any polysiloxane moieties (be they polysiloxane molecules in option (i), or the polysiloxane components of copolymers in option (ii)) are lost. In this regard, in a particularly preferred aspect of both of options (i) and (ii), the sliding facilitator may further comprise an agent which facilitates migration of the polysiloxane/copolymer molecules within the structure of the sliding facilitator. This agent may be any agent which provides a mineral-like skeleton/scaffold within the copolymer to provide possible pathways along which the polysiloxane/copolymer molecules may migrate.

Thus, the agent may be any inert compound, typically an inorganic compound, the inclusion of which provides a pathway along which polysiloxane moieties may migrate towards the surface of the substance. For instance, the agent may be amorphous $SiO_2$. Typically it is fumed silica.

Preferably the agent is in particulate form. In particular, the agent is preferably a particulate product with a d50 of 0.1 to 100 μm, such as 1 to 10 μm, and typically around 3 to 7 μm. The particulate product preferably has a d90 of 0.2 to 200 μm, such as 2 to 20 μm, and typically around 7 to 17 μm. In this regard, d50 and d90 are based on a volume distribution as measured by laser diffraction, e.g. using a HORIBA laser diffraction software package (d50 is a median particle size value).

In this regard the particulate product is preferably composed of flake-like particles. Thus, the particles preferably have an aspect ratio (ratio of the largest dimension to the smallest dimension) of greater than 1, such as 2 or more, 5 or more, or 10 or more.

The use of such an agent also has the advantage that it opens up the possibility of using lower quantities of the polysiloxane/copolymer molecules, and/or achieving greater lubrication performance for a given embodiment.

For the avoidance of doubt, in all of the preferred embodiments described above in option (i) where the sliding facilitator is obtained or obtainable by a process which comprises applying to the surface a composition comprising the organic polymer, the polysiloxane, the surfactant and optionally at least one solvent, and in all of the preferred embodiments described above in option (ii) where the sliding facilitator is obtained or obtainable by a process which comprises applying to the surface a composition comprising the organic polymer, the copolymer and optionally at least one solvent, it is generally preferred that said compositions also include an agent as defined above, i.e. an agent which facilitates migration of the polysiloxane copolymer molecules within the structure of the sliding facilitator. In this regard, the concentration of the agent, if present in the composition used in these processes, may be 0.0001 to 5 wt %. Preferably it is at least 0.001 wt %, such as at least 0.01 wt %. Preferably it is at most 1 wt %.

Option the Sliding Facilitator Comprises a Non-Elastomeric Cross-Linked Polymer Obtained or Obtainable by Subjecting a Polysiloxane and on Organic Polymer to a Cross-Linking Reaction Preferably in this option the polysiloxane and/or one or more of the organic polymer(s) is(are) functionalised.

In this option the sliding facilitator preferably comprises a coating based substantially on said cross-linked polymer on said surface (of one or both of said layers). More preferably the sliding facilitator comprises a coating of said cross-linked polymer on said surface, and polysiloxane moieties on the contact surface of the coating (although in practice at least some polysiloxane moieties may be incorporated within the coating). Generally, as discussed above, the sliding facilitator preferably has a contact surface based (substantially) on silicon and oxygen which in this option means it is based on polysiloxane components of the cross-linked polymer. Thus, preferably the contact surface of the sliding facilitator comprises polysiloxane as the main component. Typically the contact surface of the sliding facilitator consists essentially of polysiloxane.

In a particularly preferred embodiment, the sliding facilitator is obtained or obtainable by a process which comprises applying to said surface a composition comprising an organic (non-cross-linked, but cross-linkable (i.e. curable)) polymer, a functionalised polysiloxane, and optionally at least one solvent, and cross linking (i.e. curing) the thus applied composition. In this regard, the process may further comprise an additional step in which the composition dries/solidifies (e.g. the applied composition may just be allowed to dry/solidify at room temperature, e.g. for 1 to 5 days, and/or drying/solidification may be accelerated e.g. by means of the application of heat and/or reduced pressure) such that solvent evaporates and a coating comprising the cross-linked polymer remains on the surface. Thus, the sliding facilitator is preferably obtained or obtainable by a process which comprises (a) applying to said surface a composition comprising an organic non-cross-linked (curable) polymer, a functionalised polysiloxane, optionally one or more curing agents, and optionally at least one solvent, (b) subjecting the thus applied composition to curing, and optionally (c) allowing the composition to dry.

In relation to the above process, preferably the organic polymer and at least one (of said at least one or more) solvent(s) together account for at least 60% by weight of the composition, more preferably at least 80%© by weight, and more preferably still at least 90% by weight. The organic polymer and solvent together may account for up to 99% by weight of the composition, such as up to 98% by weight, or up to 97% by weight. Typically the organic polymer and solvent together account for around 95% by weight of the composition. The relative amounts of organic polymer and solvent are preferably such that there is sufficient solvent to dissolve the organic polymer (e.g. at standard pressure and temperature). The organic polymer may account for at least 1% by weight of the composition, such as at least 2% by weight, at least 5% by weight, at least 10% by weight, or at least 20% by weight.

In relation to the above process, preferably the functionalised polysiloxane and optionally at least one (further) solvent together account for at least 1% by weight of the composition, more preferably at least 2% by weight, and more preferably still at least 3% by weight. The functionalised polysiloxane and optionally at least one (further) solvent together may account for up to 40% by weight of the composition, such as up to 20% by weight, or up to 10% by weight. Typically the functionalised polysiloxane and optionally at least one (further) solvent together account for around 5% by weight of the composition. The functionalised polysiloxane may account for at least 0.1% by weight of the composition, such as at least 0.2% by weight, at least 0.5% by weight, at least 1% by weight, at least 2% by weight, or at least 4% by weight.

Typically the composition is obtained or obtainable by mixing (a) a first reagent comprising the organic polymer and optionally at least one solvent, and (b) a second reagent comprising the functionalised polysiloxane and optionally at least one (further) solvent. Thus, often the composition comprises a mixture of two or more solvents. The solvents may include organic and/or aqueous solvents (e.g. water). Preferably the solvents comprise organic solvents (and preferably not water). Preferred organic solvents (in particular for the first reagent) include alkyl esters such as butyl or amyl acetate, ketones such as acetone, methyl isobutyl ketone or cyclohexanone, aromatic hydrocarbons such as xylene, ethers such as glycol cellosolves, alcohols, and mixtures thereof.

More generally, possible solvents for use in this regard may include alkyl esters such as butyl or amyl acetate, ketones such as acetone or methyl ethyl ketone, aromatic hydrocarbons such as toluene, ethers such as glycol cellosolves, alcohols, and mixtures thereof. In another embodiment the solvents for use in this regard may include water, an ether or an ester. Suitable examples of ethers include glycol ethers such as 2-methoxyethanol, 2-ethoxyethanol, 2-propoxyethanol, 2-isopropoxyethanol, 2-butoxyethanol, 2-phenoxyethanol, 2-benzyloxyethanol, 2-(2-methoxyethoxy)ethanol, ethoxyethoxy)ethanol, and 2-(2-butoxyethoxy)ethanol; and dialkyl ethers such as dimethoxyethane, diethoxyethane, and dibutoxyethane. Examples of esters include 2-methoxyethyl acetate, 2-ethoxyethyl acetate, 2-butoxyethyl acetate, and 1-methoxy-2-propanol acetate.

The organic polymer may be a polyether (e.g. poly (ethylene oxide), poly(proplene oxide)), polyester, polyepoxide, polyolefin (e.g. polyethylene, polypropylene, polyisobutylene), polyurethane, polyacrylate, polymethacrylate, poly(methyl methacrylate), polyacrylonitrile, polyamide, polyacrylamide, polyimide, poly(ethyleneimine), polyphosphazine, polyvinyl acetate, alkyd, polyvinyl chloride, polystyrene, poly(vinylidene chloride), polyisoprene, polytetrafluoroethylene, or a mixture of two or more thereof. Preferably it is a polyether, polyacrylate, polyurethane, alkyd, or a mixture of two or more thereof (in this regard the polyether is preferably a polymer of ethylene oxide, propylene oxide, or a mixture of ethylene oxide and propylene oxide). More preferably it is an acrylate, polyurethane, polyester, polyepoxide, alkyd, or a mixture of two or more thereof. More preferably still it is an acrylate, polyurethane, polyepoxide, alkyd, or a mixture of two or more thereof. Most preferably it is an acrylate or a mixture of an acrylate with one or more further polymers (such as polyepoxides).

The number average molecular weight of the organic polymer is preferably at least 150, more preferably at least 500, such as at least 1,000. As regards possible upper limits for the number average molecular weight, usually it is no more than 100,000, preferably no more than 50,000, such as 20,000 or less, or 10,000 or less.

The functionalised polysiloxane is preferably a linear, branched or cyclic polysiloxane as defined above in option (i) (subject of course to being functionalised), except that in this instance the number average molecular weight of the polysiloxane is preferably at least 500, more preferably at least 1000, such as at least 2,000 or at least 5,000. As regards possible upper limits for the number average molecular weight, usually it is no more than 500,000, preferably no more than 100,000, more preferably no more than 50,000, such as no more than 20,000 or no more than 10,000. The weight average molecular weight of the polysiloxane is preferably at least 5,000, more preferably at least 10,000. The weight average molecular weight of the polysiloxane is preferably no more than 30,000, more preferably no more than 20,000. Typically the weight average molecular weight of the polysiloxane is around 12,000 to 18,000, such as around 15,000.

Preferably the functionalised polysiloxane is (based on) PDMS, i.e. is functionalised PDMS.

The functionalised polysiloxane (and optionally also the organic polymer) includes one or more functional groups for cross linking. Possible functional groups that may be incorporated in this regard include silane, alkenyl, hydroxyl, carboxyl, epoxy, methacrylate, acrylate, amino or thiol. The functional group is preferably hydroxyl, and in particular hydroxyl in the form of a carbinol (—$CH_2$—OH) group. This applies in particular to the functional polysiloxane. Suitable functionalised polysiloxanes arc' available commercially, e.g. the product BYK-Silclean 3700.

In a preferred aspect of the invention the functionalised polysiloxane is functionalised with hydroxyl groups and the organic polymer is a hydroxyl cross linking polymer, such as a polyacrylate. In a particularly preferred aspect of the invention the functionalised polysiloxane is functionalised with hydroxyl groups and the organic polymer is a polyurethane. More preferably in this regard, the polyurethane is used with di-isocyanate cross-linker.

There is flexibility in designing the cross-linked polymer. Thus, the extent of any possible cross linking between the polysiloxane and the organic polymer may be controlled by adjusting the severity of the cross linking reaction conditions, the amount (if any) of curing agent present, and/or the length of time for which the reaction conditions are maintained. In addition the starting polysiloxane and organic polymer may be varied in terms of molecular weight, molecular structure (pendant/linear), composition of the organic polymer chain (e.g. ethylene vs propylene in the case where the organic polymer is polyether), and ratio of polysiloxane to organic polymer.

Cross linking may be effected by known means including e.g. beating, radiation and/or the use of curing agents. If one or more curing agents are being used, obviously these are included together with the polymeric reagents to be cross-linked in the above mentioned processes. Possible curing agents include amines (such as diethylenetriamine, triethylenetetramine, isophoronediamine, diaminodiphenylmethane, diaminodiphenylsulfone), isocyanates, succinic anhydride, phthalic anhydride, maleic anhydride, benzenetetracarboxylic acid anhydride, polyphosphoric acid esters, formic acid:hydrogen peroxide systems, polyamides, dicyandiamide, hexahydrophthalic anhydride, methyltetrahydrophthalic anhydride, methyl nadic anhydride, tertiary amines, imidazoles, melamine. Lewis acids such as boron trifluoride and amine complexes thereof, tertiary amines, quaternary ammonium halides, and combinations thereof.

The cross-linked polymer in option (iii) is preferably obtained or obtainable by a process of:

(a) mixing a functionalised polysiloxane and an organic (non-cross-linked, curable) polymer (and preferably also a curing agent), optionally in the presence of a solvent, and (b) subjecting the mixture of the functionalised polysiloxane and organic polymer and preferably also the curing agent) to a cross linking reaction.

The solvent, if present, is preferably water, an ether or an ester. Suitable examples of ethers include glycol ethers such as 2-methoxyethanol, 2-ethoxyethanol, 2-propoxyethanol, 2-isopropoxyethanol, 2-butoxyethanol, 2-phenoxyethanol, 2-benzyloxyethanol, 2-(2-methoxyethoxy)ethanol, 2-(2-ethoxyethoxy)ethanol, and 2-(2-butoxyethoxy)ethanol; and dialkyl ethers such as dimethoxyethane, diethoxyethane, and dibutoxyethane. Examples of esters include 2-methoxypropyl acetate, 2-methoxyethyl acetate, 2-ethoxyethyl acetate, 2-butoxyethyl acetate, and 1-methoxy-2-propanol acetate.

Typically the solvent is an organic solvent. Preferably the solvent is an ester, and more preferably it is 2-methoxypropyl acetate.

Examples of preferred embodiments include cross-linked polymers obtained or obtainable by the above process, wherein step (a) comprises mixing the polysiloxane with one of the following systems, namely a 2-pack polyurethane, alkyd/melamine, polyester/melamine, acrylate/malamine, acrylate/epoxy, a 2-pack epoxy system (in particular bisphenol A/polyamide curing agent), a 2-pack polyurethane system (in particular OH-functionalised acrylate with aliphatic-aromatic and/or pure aliphatic polyisocyanate), and an acid-catalysed stoving system (acrylate/melamine).

Preferably step (b) comprises mixing the polysiloxane with an acrylate/melamine system, an acrylate/epoxy system, or a system featuring OH-functionalised acrylate with aliphatic-aromatic and/or pure aliphatic polyisocyanate.

The cross-linked polymer is non-elastomeric. Thus, it should not be a rubber, and so preferably should have a Young's modulus of greater than 0.05 GPa, preferably at least 0.1 GPa, such as at least 0.2 GPa, at least 0.3 GPa, at least 0.4 GPa, at least 0.5 GPa, at least 0.6 GPa, at least 0.7 GPa, at least 0.8 GPa, at least 0.9 GPa, at least 1 GPa. Young's modulus may be measured by standard tests, e.g. ASTM E111-04(2010).

In all of the options (i) to (iii) described above, when reference is made to processes of applying a composition to a surface, this may preferably be done by printing the composition onto the layer, more preferably by screen printing.

EXAMPLES

Testing was conducted to investigate the possibility of developing a layer or coating which could serve as a helmet. The layer could be e.g. the structure material in the sliding shell or a lacquer added to the sliding shell. Additives were tested in lacquers. In particular, compositions were tested for their suitability for use as a sliding facilitator by applying them to a carrier and measuring dynamic coefficients of friction. Low friction is beneficial. Similar results may be expected if the additives are incorporated in the polymeric structural material.

Lacquer Application

The friction reducing additive was mixed with lacquer and brushed on to a 0.8 mm polycarbonate sheet made for vacuum forming. Friction measurements were taken after drying for 3 days at room temperature. This is the case for sliding shells being lacquered after vacuum molding. The case when lacquering is done before the molding was mimicked by giving the dried lacquered sheet a 1 minute heat treatment at 160° C. and then letting the sample age for 3 days at room temperature. This is similar to the heat treatment in the vacuum molding process.

Friction Measurement

EPS (expanded polystyrene) used for testing was of a similar type as is used in helmets. That is particle based EPS with a carrying capacity 300 KPa. The EPS surface in the measurement was treated so as to be similar to what is used in helmets by first sanding the surface clean, then applying a thin Teflon foil on top of that. This Teflon surface was then pressed with a 140° C. hot iron for 5 seconds at 1 KPa pressure. Then within 2 seconds, a room temperature iron was applied at 1 KPa pressure during 10 seconds. This made a clean, sealed, flat surface similar to the foam in the helmet.

Friction measurements were performed with a pressure slightly lower than the maximum carrying capacity of the EPS that is used in helmets. 380 $mm^2$ with 9 kg load is used and that makes 232 KPa pressure. The sliding speed at measurement is 5 cm/sec. Dynamic coefficient of friction measurements according to ISO 15359 are reported. Static coefficients of friction were also measured by using the same set up as above but reading the force when the sliding just starts.

Substances for Use:

A. Waterbased matt floor lacquer, "Alcro golvlack halvmatt"

B. PTFE spray "Roccol"

C. Jotun "Hardtop AS". Solvent based 2-component PUR lacquer

D. Silicone "BYK-Silclean 3700". In situ cured silanol terminated polysiloxane

E. Type 1 solvent based matt screen printing ink made of blended polymer resins

F. Type 2 solvent based matt screen printing ink made of blended polymer resins

G. Type 2 solvent based glossy screen printing ink made of blended polymer resins H. Silicone DC 52 from Dow Corning. Polysiloxane with surfactant I. Silicone DC 57 from Dow Corning, Polysiloxane block ether co-polymer J. Silicone DC 2055 from Dow Corning. Polysiloxane block ether co-polymer All lacquers were applied on flat, glossy 0.8 mm polycarbonate sheets for friction measurements.

Results:

| Lacquer | Additive | Treatment and notes | Dynamic friction | Static friction |
|---|---|---|---|---|
| none | none | Bare polycarbonate sheet | 0.24 | 0.28 |
| A | 5% F (DC52) | | 0.10 | 0.10 |
| A | 5% F (DC52) | Dry Steel wool abraded | 0.10 | 0.10 |
| none | B | PC-sheet Teflon sprayed | 0.17 | 0.17 |
| C | none | Only PUR lacquer | 0.17 | 0.17 |
| C | D (BYK 3700) | PUR lacquer with reacted silicone | 0.06 | 0.06 |
| C | D (BYK 3700) | PUR lacquer with reacted silicone. 24 h water soaked | 0.06 | 0.06 |
| C | D (BYK 3700) | PUR lacquer with reacted silicone. Steel wool abraded | 0.08 | 0.13 |
| | | | 0.10 | 0.11 |
| E | none | Printing ink type 1 | | |
| E | 5% H (DC 52) | | 0.08 | 0.09 |
| E | 5% I (DC 57) | | 0.11 | 0.14 |
| E | 5% J (DC205S) | | 0.11 | 0.11 |
| E | none | Heat aged | 0.12 | 0.12 |
| E | 5% H (DC 52) | Heat aged | 0.07 | 0.09 |
| E | 5% I (DC 57) | Heat aged | 0.14 | 0.17 |
| E | 5% J (DC205S) | Heat aged | 0.07 | 0.07 |
| F | 5% H (DC 52) | Printing ink type 2 matt no heat treatment | 0.12 | 0.13 |
| G | 5% H (DC 52) | Printing ink type 2 glossy no heat aging | 0.24 | 0.24 |
| F | 5% H (DC 52) | Printing ink type 2 matt with heat aging | 0.05 | 0.05 |
| G | 5% H (DC 52) | Printing ink type 2 glossy with heat aging | 0.18 | 0.18 |

Brain Acceleration Measurement

Figure 6:
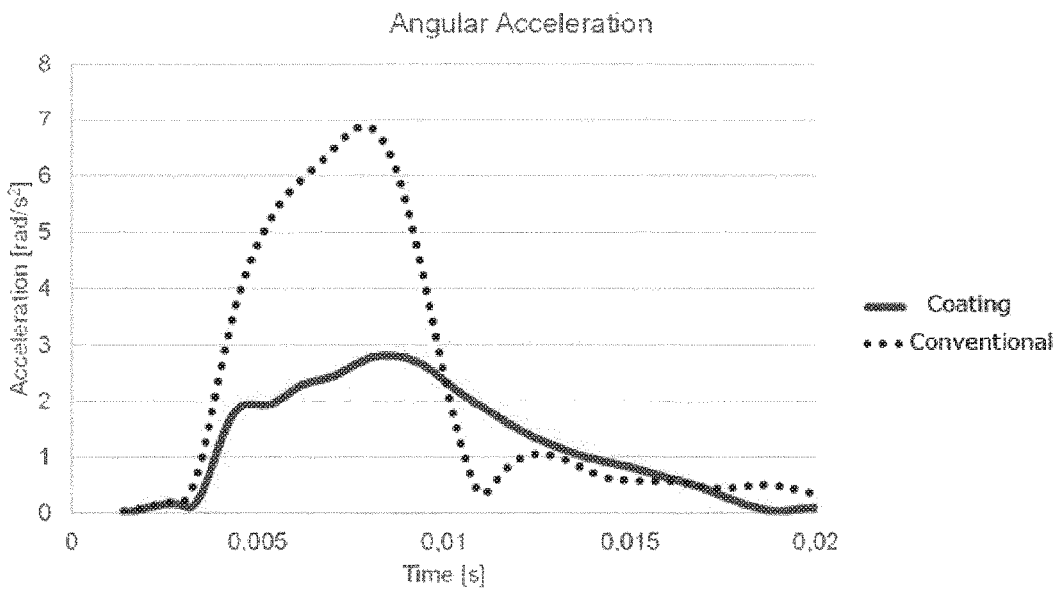
FIG. 6 depicts angular acceleration measurements for a conventional helmet as compared to a helmet having a sliding facilitator in accordance with the present invention.

Angular acceleration measurements were taken for a conventional helmet vs a helmet containing a sliding facilitator in accordance with the present invention (E 5% H(DC52)). Sliding friction coefficient was 0.07 on this coating. The tests were performed by dropping the helmets against a 45 degrees anvil at 6 m/s. Acceleration was measured inside the head. FIG. 6 illustrates the advantageous effect of the sliding facilitator.

What is claimed is:

1. A helmet comprising:

two layers configured to slide with respect to each other; and wherein each of the two layers respectively has a surface and the surface of one or both layers comprises a sliding facilitator which provides slidability between the two layers, wherein the two layers configured to slide with respect to each other are each disposed within an outer shell of the helmet, and wherein the sliding facilitator comprises (i) an organic polymer, a polysiloxane and a surfactant, wherein the surfactant is a fatty alcohol alkoxylate of formula $R'[O\text{-}Q\text{-}]_mOH$, wherein m is 1 to 20, Q is a divalent hydrocarbyl moiety containing 1 to 10 carbon atoms, and R' is a hydrocarbyl group containing 6 to 22 carbon atoms;

or (ii) a non-elastomeric cross-linked polymer obtained or obtainable by subjecting a polysiloxane and an organic polymer to a cross-linking reaction;

wherein when the sliding facilitator comprises a non-elastomeric cross-linked polymer, the sliding facilitator is either obtained or obtainable by a process which comprises (a) applying to said surface a composition comprising a curable organic polymer, a functionalised polysiloxane, optionally one or more curing agents, and optionally at least one solvent, (b) subjecting the thus applied composition to curing, and optionally (c) allowing the composition to dry; or obtained or obtainable by a process which comprises (a) applying a functionalised polysiloxane to a solid surface which includes an organic polymer, (b) subjecting the thus applied composition to curing, and optionally (c) allowing the composition to dry.

2. A helmet according to claim 1, wherein the sliding facilitator has a contact surface including siloxane and an internal surface including organic polymer.

3. A helmet according to claim 1, wherein the sliding facilitator comprises an organic polymer, a polysiloxane and a surfactant, and is obtained or obtainable by a process which comprises (a) applying to said surface a composition comprising the organic polymer, the polysiloxane, the surfactant and optionally at least one solvent, and optionally (b) allowing the thus applied composition to dry.

4. A helmet according to claim 1, wherein the sliding facilitator comprises an organic polymer, a polysiloxane and a surfactant, and is obtained or obtainable by a process which comprises applying the polysiloxane and the surfactant and optionally also at least one solvent to a solid surface which comprises an organic polymer.

5. A helmet according to claim 1, wherein the polysiloxane is polydimethylsiloxane (PDMS).

6. A helmet according to claim 1, wherein the number average molecular weight of the polysiloxane is at least 50,000 and no more than 2,000,000.

7. A helmet according to claim 1, wherein the sliding facilitator further comprises an agent which facilitates migration of the polysiloxane or copolymer molecules within the structure of the sliding facilitator, wherein the agent is an inert inorganic product in particulate form.

8. A helmet according to claim 1, wherein the sliding facilitator is defined according to option (ii) in claim 1, and is obtained or obtainable by a process which comprises (a) applying to said surface a composition comprising a curable organic polymer, a functionalised polysiloxane, optionally one or more curing agents, and optionally at least one solvent, (b) subjecting the thus applied composition to curing, and optionally (c) allowing the composition to dry.

9. A helmet according to claim 1, wherein the sliding facilitator is defined according to option (ii) in claim 1, and is obtained or obtainable by a process which comprises (a) applying a functionalised polysiloxane to a solid surface which includes an organic polymer, (b) subjecting the thus applied composition to curing, and optionally (c) allowing the composition to dry.

10. A helmet according to claim 1, wherein the sliding facilitator is defined according to option (ii) in claim 1, and wherein the number average molecular weight of the functionalised polysiloxane is at least 5,000 and no more than 20,000.

11. A helmet according to claim 1, wherein the sliding facilitator is defined according to option (ii) in claim 1, and wherein the polysiloxane is PDMS.

12. A helmet according to claim 1, wherein the sliding facilitator is defined according to option (ii) in claim 1, and wherein the functionalised polysiloxane is functionalised with hydroxyl groups and the organic polymer is a hydroxyl cross linking polymer.

13. A helmet according to claim 1, wherein one, and optionally both, of the two layers are made of foam material.

14. A helmet according to claim 13, wherein the foam material is expanded polystyrene (EPS), expanded polypropylene (EPP), expanded polyurethane (EPU), or vinyl nitrile foam.

15. A helmet according to claim 1, wherein the surface, or surfaces, to which the sliding facilitator is applied is, or are, solid surfaces.

16. A helmet according to claim 1, wherein the sliding facilitator is defined according to option (i) in claim 1.

17. A method of manufacturing the helmet defined in claim 1, the method comprising:

applying or forming the sliding facilitator on the surface of a first layer of the two layers of the helmet; and arranging the first layer with respect to a second layer of the two layers of the helmet such that the two layers are configured to slide with respect to each other, with the sliding facilitator positioned between the two layers;

wherein the sliding facilitator comprises (i) an organic polymer, a polysiloxane and a surfactant;

(ii) an organic polymer and a copolymer based on a polysiloxane and an organic polymer; or (iii) a non-elastomeric cross-linked polymer obtained or obtainable by subjecting a polysiloxane and an organic polymer to a cross-linking reaction.

18. A method according to claim 17, wherein the sliding facilitator on the helmet comprises a contact surface based on siloxane and an internal surface based on organic polymer.

19. A method according to claim 17, wherein the sliding facilitator comprises an organic polymer, a polysiloxane and a surfactant, and the method comprises (a) applying to said surface a composition comprising the organic polymer, the polysiloxane, the surfactant and optionally at least one solvent, and optionally (b) allowing the thus applied composition to dry.

20. A method according to claim 17, wherein the sliding facilitator comprises an organic polymer and a copolymer based on a polysiloxane and an organic polymer, and the method comprises (a) applying to said surface a composition comprising the organic polymer, the copolymer and optionally at least one solvent, and optionally (b) allowing the thus applied composition to dry.

21. A method according to claim 17, wherein the sliding facilitator comprises a non-elastomeric cross-linked polymer obtained or obtainable by subjecting a polysiloxane and an organic polymer to a cross-linking reaction, and the method comprises subjecting a polysiloxane, an organic polymer, and optionally one or more curing agents to a cross linking reaction.

22. A method according to claim 17, wherein the sliding facilitator is applied by printing the sliding facilitator onto the first layer, optionally by screen printing.

* * * * *